US008016644B2

(12) United States Patent
Curodeau et al.

(10) Patent No.: US 8,016,644 B2
(45) Date of Patent: Sep. 13, 2011

(54) METHOD AND APPARATUS FOR MICRO-MACHINING A SURFACE

(75) Inventors: Alain Curodeau, Québec (CA); Louis Brault, St-Augustin-de-Desmaures (CA); Julie Guay, Gatineau (CA)

(73) Assignee: Université Laval, Montréal, Québec (CA)

( * ) Notice: Subject to any disclaimer, the term of this patent is extended or adjusted under 35 U.S.C. 154(b) by 316 days.

(21) Appl. No.: 11/778,008

(22) Filed: Jul. 13, 2007

(65) Prior Publication Data

US 2009/0017732 A1 Jan. 15, 2009

(51) Int. Cl.
*B24B 1/00* (2006.01)

(52) U.S. Cl. ..... 451/56; 451/165

(58) Field of Classification Search ..... 451/56, 451/156

See application file for complete search history.

(56) References Cited

U.S. PATENT DOCUMENTS

| | | | | |
|---|---|---|---|---|
| 3,584,179 | A | | 6/1971 | Schroeder |
| 3,585,342 | A | | 6/1971 | Kosco |
| 3,619,286 | A | | 11/1971 | Gutnajer |
| 3,783,224 | A | | 1/1974 | Schroeder |
| 3,971,133 | A | | 7/1976 | Mushabac |
| 4,098,652 | A | | 7/1978 | Koenig |
| 4,373,127 | A | | 2/1983 | Haskett et al. |
| 4,459,453 | A | | 7/1984 | Inoue |
| 4,469,654 | A | | 9/1984 | Haskett et al. |
| 4,647,748 | A | | 3/1987 | Glassman |
| 4,717,804 | A | | 1/1988 | Tomalin |
| 4,754,115 | A | | 6/1988 | Rhoades |
| 4,850,147 | A | | 7/1989 | Baker |
| 5,095,602 | A | | 3/1992 | Reher et al. |
| 5,125,191 | A | * | 6/1992 | Rhoades ..... 451/36 |
| 5,187,899 | A | | 2/1993 | Rhoades |
| 5,341,602 | A | | 8/1994 | Foley |
| 5,354,961 | A | | 10/1994 | Diot et al. |
| 5,461,769 | A | | 10/1995 | McGregor |
| 5,619,889 | A | * | 4/1997 | Jones et al. ..... 76/104.1 |
| 5,709,823 | A | * | 1/1998 | Hahn ..... 264/16 |
| 5,735,335 | A | | 4/1998 | Gilmore et al. |
| 5,762,830 | A | | 6/1998 | Long et al. |
| 5,775,911 | A | | 7/1998 | Hahn |
| 5,818,005 | A | | 10/1998 | Pratt et al. |
| 5,919,380 | A | | 7/1999 | Magara et al. |
| 5,933,701 | A | | 8/1999 | Stucker et al. |
| 5,976,339 | A | | 11/1999 | André, Sr. |

(Continued)

FOREIGN PATENT DOCUMENTS

CA 1329988 6/1994

(Continued)

*Primary Examiner* — Maurina Rachuba
(74) *Attorney, Agent, or Firm* — Anglehart et al.

(57) ABSTRACT

An apparatus and method for micro-machining a surface of a workpiece having a complex surface profile including desired profile features and finer undesired profile features to be removed, including shaping a formable polishing tool using either the workpiece itself or a replica of the workpiece to have at least said desired profile features, and using said formable polishing tool to micro-machine said surface to remove said finer undesired profile features while maintaining said desired profile features. The formable polishing tool can be shaped to have at least said desired profile features by pressing the formable polishing tool against either the workpiece itself or the replica of the workpiece when the formable polishing tool is in a formable state, and the formable polishing tool can be used for micro-machining when the formable polishing tool is in a solid state.

23 Claims, 18 Drawing Sheets

U.S. PATENT DOCUMENTS

| | | | | |
|---|---|---|---|---|
| 6,234,875 | B1 | 5/2001 | Pendergrass, Jr. | |
| 6,544,110 | B2 * | 4/2003 | Gilmore et al. | 451/106 |
| 6,645,056 | B1 * | 11/2003 | Gilmore et al. | 451/270 |
| 6,899,592 | B1 | 5/2005 | Kojima et al. | |
| 6,918,937 | B2 | 7/2005 | Gilmore et al. | |
| 6,942,554 | B1 | 9/2005 | Mandina | |
| 2003/0211014 | A1 | 11/2003 | Jacquorie et al. | |
| 2004/0241049 | A1 | 12/2004 | Carvalho | |

FOREIGN PATENT DOCUMENTS

| | | |
|---|---|---|
| CA | 2374004 | 12/2000 |
| WO | 2004089546 | 10/2004 |
| WO | 2007079168 | 7/2007 |

* cited by examiner

METHOD AND APPARATUS FOR MICRO-MACHINING A SURFACE

FIELD

This embodiments described herein relate to the field of machining and more particularly to micro-machining of a surface.

BACKGROUND

A number of non-traditional machining processes have been developed to provide alternative methods of preparing complex workpieces. Such processes are often employed in the working of castings, forged parts, composite and ceramic parts, and as a finishing step on workpieces where rough machining has been performed using more conventional techniques.

One such technique is electrical discharge machining (EDM). EDM allows removal of metal from a workpiece by the energy of an electric spark arcing between a tool and a surface of the workpiece. During use, both the tool and the workpiece are immersed in a dielectric fluid such as oil. Rapid pulses of electricity are then delivered to the tool, causing sparks to jump or arc between the tool and the workpiece. The heat from each spark causes a small portion of metal on the workpiece to melt, removing it from the workpiece. As the metal is thus removed, it is cooled and flushed away by circulation of the dielectric fluid.

EDM can generally be used to form complex and intricate shapes in a workpiece. However, EDM suffers from a number of limitations. First, the workpiece must be electrically conductive in order to close the electrical circuit necessary to create a spark between the workpiece and the tool. Thus, EDM is not suitable for use on workpieces made of many materials, such as most ceramics or polymers. Second, it can be difficult to achieve the desired final finish to the surface of a workpiece using EDM, and surfaces subjected to EDM typically have an "orange peel" or "sand blasted" appearance. For example, it may be desired to have a final surface finish as rough as 0.8 μm Root Mean Square RMS, or have a smoother mirror finish at approximately 0.02 μm RMS. EDM typically yields, at best, a surface finish between 0.8 and 3.2 μm RMS. Thus, while EDM can be useful for providing a rougher finish, it is generally not suitable for providing highly polished workpieces.

Another non-traditional machining process that tends to provide a smoother finish is ultrasonic polishing, also known as ultrasonic impact grinding. Ultrasonic polishing generally involves the removal of a thin layer of material (e.g. up to 50 μm thick or less) to finish a workpiece to the desired dimensions. The polishing involves the removal of waviness on the surface of the workpiece, typically by selective removal of undesired semi-fine details (e.g. the top portion of long amplitude waveform features present on the surface or the workpiece) and undesired fine details or surface roughness (e.g. the top portion of short amplitude waveform features present on the surface of the workpiece) while leaving desired surface features intact.

Polishing of the workpiece is effected by rapid and forceful agitation of fine abrasive particles suspended in slurry located between the surface of the workpiece and the face of a tool. In order to agitate the abrasive particles in the slurry, during operation the tool is vibrated at frequencies that are generally between 15,000 Hz and 40,000 Hz, although it is possible to use much higher or lower frequencies according to the needs of a particular application.

Various techniques can be used to effect vibration of the tool. One method is to use a magneto-restrictive actuator, where a magnetic field is cyclically applied to a ferromagnetic core. Application of the field causes an effect known as magnetorestriction, whereby the core length changes slightly in response to fluctuations in the magnetic field intensity. Another method to effect vibration uses a piezoelectric transducer that oscillates in response to the application of an electric field, as is known in the art. The transducer is then typically connected to a horn or concentrator having a tool at the working end thereof. The horn increases the amplitude of the oscillation of the tool relative to the oscillation of the actuator or transducer. The horn typically has a generally frustoconical shape, with the tool connected to the narrower working end and the actuator or transducer affixed at the wider or larger end.

During operation, the magneto-restrictive actuator causes the tool to oscillate in a direction generally parallel to the longitudinal axis of the horn, which is typically normal to the surface of the workpiece. During any single cycle, the tool moves from its uppermost position $P_1$ furthest away from the surface of the workpiece (where the tool is at rest) through a mean position $P_2$ (where the tool is moving the fastest) to the lowest position $P_3$ closest to the surface of the workpiece (where the tool is at rest again). As the cycle continues, the tool moves back through the mean position $P_2$ to the uppermost position $P_1$, and so on. In some embodiments, and depending on the configuration of a particular ultrasonic polishing apparatus, the amplitude of oscillation of the tool from $P_1$ to $P_3$ is between 13 and 62 μm, although it is possible to use much higher or lower amplitudes according to the needs of a particular application.

The interaction between the face of the tool, the workpiece and the abrasive slurry depends on the sizing relationship between the abrasive particles in the slurry and the distance between the workpiece and the tool face during the cycle. When the abrasive particles are sized such that they are large enough to be contacted by the tool at the mean position $P_2$, the abrasive tends to be impacted when the tool is moving at its highest velocity. Thus, a greater amount of momentum will generally be transferred to the particles. Where abrasive particles are smaller in size, however, they will be impacted when the tool is closer to the surface of the workpiece (between $P_2$ and $P_3$) and thus moving at a slower velocity. Thus, smaller abrasive particles will generally receive a lesser amount of momentum from the tool. Similarly, where the abrasive particles are larger in size, they tend to be impacted by the tool before it has reached its maximum velocity (between $P_1$ and $P_2$). Thus, there is typically an effective range of abrasive particles sizes (or grit sizes) that work for any particular tool and workpiece combination based on the gap between the workpiece and the tool.

During operation, when the tool impacts any particular abrasive particle, that particle will be forced against the workpiece by the action of the tool. This causes impact stresses on the surface of both the workpiece and the tool. These impact stresses occasionally cause one or more abrasive particles to become fractured, which tends to decrease the size of the particles and is one reason that it is desirable to introduce fresh abrasive particles into the slurry to ensure that the desired abrasive size is retained to ensure the rate of polishing is maintained. Introducing fresh slurry also assists with flushing of the workpiece debris away from the gap between the tool and the workpiece.

The vibrating tool thus effectively acts as a hammer that periodically strikes the abrasive particles and chips out small portions of the workpiece. Material is removed from the workpiece by three main modes: (a) ballistic or cavitation effects causing the abrasive particles to impact the surface of the workpiece, (b) mechanical effects caused by abrasive particles flowing back and forth generally parallel to the workpiece surface (caused by the movement of the slurry), and (c) mechanical effects caused by particles vibrating over the surface of the workpiece or by a buildup of abrasive particles which crush the surface of the workpiece by bridging the gap between the workpiece and the tool.

One of the major benefits of ultrasonic polishing over EDM is that ultrasonic polishing is non-thermal, non-chemical, and non-electrical. Thus, ultrasonic polishing neither requires nor creates any changes in the metallurgical, chemical or physical properties of the workpiece being polished, other than the removal of material. Ultrasonic polishing can therefore be used to shape many different types of materials, including hard materials and materials that are not electrically conductive, such as ceramics and glass, which cannot generally be shaped using EDM.

Ultrasonic polishing can also be performed without the need for the dielectric fluid required in EDM. In many cases, a simple slurry mixture of abrasive particles in water, oil or an emulsion is all that is required.

Ultrasonic polishing can also result in much smoother surface characteristics to the finished workpiece. With a proper selection of abrasive, frequency of oscillation, amplitude of oscillation, tool, and spacing between the tool and the workpiece, ultrasonic polishing can result in surfaces with mirror finishes (less than 0.25 μm RMS).

However, ultrasonic polishing also faces a number of challenges. Polishing is typically much slower than many other material removal techniques, such as EDM. Thus, it can take much longer to obtain a desired final surface. Furthermore, the tool used in ultrasonic polishing is generally made of a material that is generally softer than the workpiece. This can result in very high rates of wear to the tool in comparison to the rate of material removal from the workpiece, which can make it difficult to maintain an accurate tool shape to ensure that the workpiece receives the desired profile. As a result, it is often necessary to change tools after polishing of a single workpiece, or even use multiple tools during polishing of the same workpiece. Tools that have been worn down are often simply discarded, which can be expensive and wasteful.

Accordingly, there is a need for an improved method and apparatus for preparing workpieces having smooth, polished surfaces.

SUMMARY

According to one embodiment, there is provided a method of micro-machining a surface of a workpiece having a complex surface profile including desired profile features and finer undesired profile features to be removed, comprising shaping a formable polishing tool using either the workpiece itself or a replica of the workpiece to have at least said desired profile features, and using said formable polishing tool to micro-machine said surface to remove said finer undesired profile features while maintaining said desired profile features.

In some embodiments, the formable polishing tool is shaped to have at least said desired profile features by pressing the formable polishing tool against either the workpiece itself or the replica of the workpiece when the formable polishing tool is in a formable state, and the formable polishing tool is used for micro-machining when the formable polishing tool is in a solid state.

In some embodiments, the formable polishing tool comprises a thermoformable material being in the formable state at a first temperature and being in the solid state at a second temperature, the second temperature being lower than the first temperature, and the formable polishing tool has been shaped by pressing the formable polishing tool against either the workpiece itself or the replica of the workpiece while at the first temperature, and then cooling the formable polishing tool to the second temperature.

In some embodiments, the method further comprises oscillating the formable polishing tool against either the workpiece itself or the replica of the workpiece during cooling of the formable polishing tool to the second temperature to modify the profile of the formable polishing tool. As a result, a larger gap can be produced between the tool and the workpiece to accommodate large particles and/or larger amplitudes of orbital motion. Furthermore, this tends to create a gap over any surface features on the workpiece that could otherwise cause mechanical interference or clamping of the formable polishing tool during cooling to the second temperature.

In some embodiments, the method further comprises determining that the formable polishing tool is in a worn state, and reforming the formable polishing tool by heating the formable polishing tool to the first temperature, pressing the formable polishing tool against either the workpiece itself or the replica of the workpiece while at the first temperature, and then cooling the formable polishing tool to the second temperature.

In some embodiments, the method further comprises providing abrasive slurry between the formable polishing tool and the workpiece, wherein the use of the formable polishing tool causes the slurry to micro-machine the complex surface profile of the workpiece.

In some embodiments, auxiliary motion is applied to the formable polishing tool during micro-machining of said surface to remove said finer undesired profile features while maintaining said desired profile features, said auxiliary motion being applied to effect movement of the abrasive slurry.

In some embodiments, there is provided a method of making a component from a workpiece having a complex surface profile including desired profile features and finer undesired profile features to be micro-machined, comprising shaping a formable polishing tool using either the workpiece itself or a replica of the workpiece to have at least said desired profile features, then using the formable polishing tool to micro-machine said finer undesired profile features while maintaining said desired profile features, and then forming the component using the workpiece.

In some embodiments, the workpiece comprises a mold, and the method further comprises molding the component using the mold.

According to some embodiments, there is provided a micro-machining apparatus for micro-machining a workpiece having a complex surface profile including desired profile features and finer undesired profile features to be micro-machined, the apparatus comprising a formable polishing tool configured to micro-machine said finer undesired profile features while maintaining said desired profile features, wherein the formable polishing tool has been shaped using either the workpiece itself or a replica of the workpiece to have at least said desired profile features.

According to some embodiments, there is provided a formable polishing tool for use with a micro-machining apparatus for micro-machining a workpiece having a complex surface profile including desired profile features and finer undesired profile features to be micro-machined, wherein the formable polishing tool is configured to micro-machine said finer undesired profile features while maintaining said desired profile features, and the formable polishing tool has been shaped by using either the workpiece itself or a replica of the workpiece to have at least said desired profile features.

Further aspects and advantages of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

DETAILED DESCRIPTION

Figure 1:
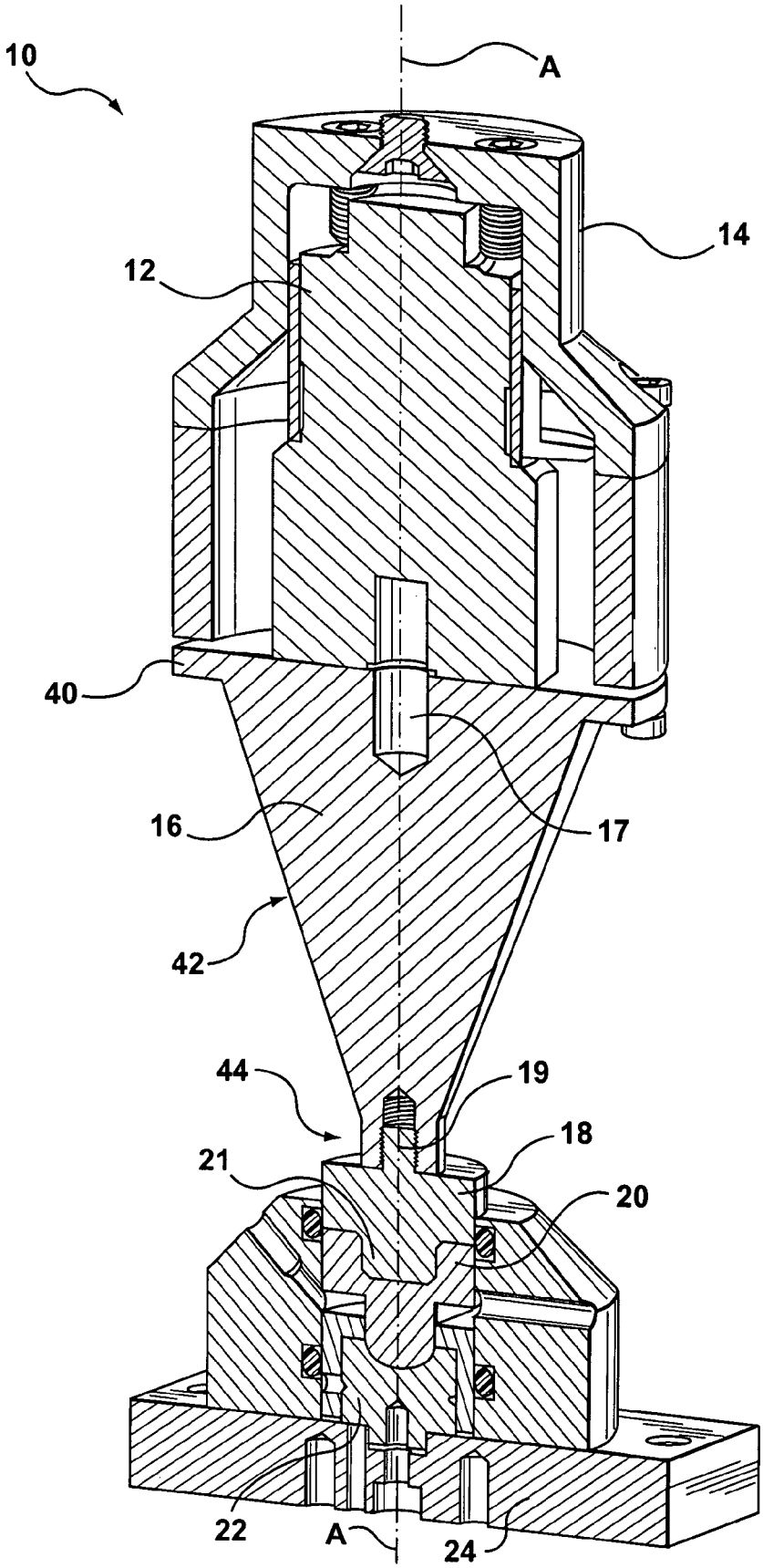
FIG. 1 is cross-sectional perspective view of a micro-machining apparatus according to one embodiment.

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

According to some embodiments, there is provided an improved method for shaping a formable polishing tool for use in the micro-machining of a workpiece. It will be understood for the purpose of this specification and claims that the term micro-machining includes ultrasonic polishing and other forms of ultrasonic machining, including removal of a thin uniform layers of material down to the desired dimensions (e.g. machining a finish or finishing) and polishing undesired surface roughness. More particularly, micro-machining includes polishing the surface roughness of a surface, such as polishing a C3 surface finish down to a B1 surface finish. Micro-machining also includes machining that involves material removal in a layer-by-layer fashion, such as machining an even 0 to 50 μm layer thick of material while preserving desired profile features.

In some embodiments, the formable polishing tool comprises at least a portion or a layer made of a material that has a formable state wherein the material can be shaped, and a solid state wherein the material is rigid and resists deformation. The formable material could include a material that has a malleable or pliable state, such as a thermoformable material (e.g. a polymer) that can be shaped by application of force when heated, as well as a material that has a liquid or other states where the material can be poured and set or cast using a form. The material of the formable polishing tool is first provided in the formable state, and the formable polishing tool is then molded or shaped using a form. In some embodiments, this may involve pressing a formable polishing tool that is in a malleable or pliable state against the form. In other embodiments, this may involve providing the material in a liquid form and then casting the formable polishing tool in the form.

In some embodiments, this form can constitute the actual workpiece that will be worked by micro-machining using the formable polishing tool. In other embodiments, the form can be a replica or a model of all or a segment of the workpiece that is to be worked by micro-machining using the formable polishing tool. For example, the formable polishing tool may be provided as only a portion of a particular workpiece to be micro-machined, and a number of differently shaped formable polishing tools may need to be used to effect micro-machining of the entire workpiece.

The formable polishing tool is then transitioned from the formable state to the solid state. This can be done using various techniques depending on the type of material used in the formable polishing tool. For example, if the material is a polymer or other thermoformable material, the formable polishing tool can be heated to achieve the formable state, and cooled to achieve the solid state. Alternatively, if the formable polishing tool material is a certain type of thermoset, the formable polishing tool may need to be heated to effect setting of the material. Where the formable polishing tool material is cast in a liquid form, the transition from formable state to the solid state may occur by cooling or by chemical reaction. Alternatively, some thermosets could be used where the thermoset can be repeatedly melted without being degraded and can be re-shaped much like a thermoplastic polymer.

In some embodiments, the formable polishing tool can be made using epoxy-based materials. An epoxy resin can be mixed with a filler, and then poured into the form (e.g. workpiece or replica) while in the formable state as a liquid. The epoxy can then solidify without the need for heating or cooling, transitioning to the solid state. Alternatively, one of the resin and the filler can be provided in the form, and then the other added to the form to effect the transition to the solid state.

Once the formable polishing tool has achieved the solid state, it can then be used to work the surface of the workpiece, such as by micro-machining the surface of the workpiece. In some embodiments, this can be done by addition of abrasive slurry between a face of the formable polishing tool and the surface of the workpiece. In other embodiments, the abrasive particles can be incorporated within the formable polishing tool, which can be applied directly to the surface of the workpiece without the need for abrasive slurry in the gap. The formable polishing tool can then be oscillated by a piezoelectric transducer or other suitable technique to micro-machine the surface of the workpiece.

In this manner, the formable polishing tool can be used to micro-machine workpieces having highly complex surface profiles by removing finer undesired profile features to achieve the desired surface finish. Generally, a complex surface profile includes surfaces that have at least a combination of one or more primitive geometrical solid body shapes. For example, a complex surface profile could include a cylinder with a V-groove or one or more rectangular prisms having rounded edges. A complex surface profile can also include a surface that is designed and defined without specific reference to basic geometric shapes, such as a profile intended to correspond to the surface of a physical object, such as a human finger or limb for use in molding parts of an artificial limb.

Furthermore, the workpiece could be any type of desired complex part such as orthopedic prostheses, turbine blades or any 3D part geometry that need not necessarily have the shape of a mold cavity. For example, a confined area of an orthopedic prosthesis may need polishing to provide a good bearing surface. A formable polishing tool could be used to micro-machine a local region of a part such as the orthopedic prosthesis to provide the specific bearing surface. Micro-machining could be performed without altering any of the surrounding surfaces in order to give a desired surface finish only where expressly desired.

According to some embodiments, the use of the formable polishing tool in the manner described allows the complex surface profile of the workpiece to be micro-machined to remove a finer level of undesired profile features while keeping a desired level of profile detail. For example, this could include removing undesired thin uniform layers of material in excess of the profile feature such as a white layer or heat affected zone left by EDM machining, as well as undesired profile features such as tool marks left behind from a conventional machining process or craters or projections left by the EDM process. However, the desired profile features, such as the desired geometry of the mold (including any curvatures, cuts, relief features or other elements of the complex surface profile) can be retained. Thus, a desired surface finish can be achieved.

According to some embodiments, as the formable polishing tool is worn down, it can be refinished by returning the formable polishing tool to the formable state, and then repeating the same or a similar forming process to redress or reform the formable polishing tool.

In some embodiments, when in the solid state the formable polishing tool will generally be slightly smaller in size than the form that was used to mold it, due to contraction of the formable polishing tool when transitioning from the formable state to the solid state. In some embodiments, if it is desired that the formable polishing tool have different dimensional properties, a secondary process can be performed whereby the formable polishing tool can be returned to the formable state after it is formed, inserted into the form, and then returned to the solid state while a 3D orbital motion is applied. In this manner, the formable polishing tool can be made to have an even smaller size or provided with a positive gap width over re-entrant surface features to inhibit mechanical interference or clamping during cooling to the solid state. It will of course be understood that this secondary process may not be available when the formable polishing tool material is a certain type of thermoset, for example, or when the material of the formable polishing tool cannot be provided in a malleable or pliable state.

In some embodiments, the formable polishing tool can be molded over a thin film of thermoplastic or elastomeric material that would be applied on the workpiece surface (such as by thermoforming, hydroforming, spraying or brushing onto the surface) prior to molding of the formable polishing tool. Once the thin film, typically of generally even thickness, covers either the entire surface or a portion of the surface of the workpiece, the formable polishing tool can be molded over this film. After the formable polishing tool has solidified, the formable polishing tool and film (which now form a single composite part) can be removed from the workpiece. The film can then be removed (such as by mechanically removing the film or dissolving the film in a solvent) to provide the formable polishing tool with the desired profile surface dimensions.

For example, a thin film of water-soluble thermoplastic material such as a cellulose-based water-soluble polymer, or other water-soluble thermoplastic formulated with hydroxyl group termination (—OH), could be thermoformed over the surface of the entire cavity of a mold prior to forming a formable polishing tool comprising a UHMWPE polymer matrix filled with 10% alumina. Once the water soluble film and the UHMWPE formable polishing tool are molded, solidified, and removed from the workpiece, the formable polishing tool could then dipped in boiling water in order to dissolve the film, leaving a formable polishing tool having a smaller overall size generally proportional to the initial workpiece dimensions minus the film thickness.

In another example, the formable polishing tool could be molded over a thin, flexible silicone membrane stretched over the workpiece. As the mold pressure is increased, the membrane takes the shape of the workpiece and an undersized formable polishing tool is fabricated in proportion to the workpiece dimensions minus the stretched membrane thickness. Once formed, the membrane can be removed from the formable polishing tool by simply pulling the membrane off of the formable polishing tool.

In some embodiments, after the formable polishing tool has been formed it can be dipped or otherwise exposed to a solvent for a predetermined amount of time to dissolve a prescribed amount of material from the surface of the formable polishing tool, giving the tool a smaller overall profile. For example, a formable polishing tool made of 90% ABS and 10% Alumina can be dipped in methanol or acetone for several seconds and then rinsed with water to stop the dissolving process. As a result, the dimensions of the formable polishing tool can be uniformly reduced in proportion to the time the formable polishing tool was exposed to the solvent.

In some embodiments, such as where the formable polishing tool has a generally solid core, a 3D oscillatory motion can be applied during the initial forming of the formable polishing tool as it transitions from the formable state to the solid state. This method may allow formable polishing tools of various materials, including formable polishing tools made of certain thermoset materials, to be formed having the desired dimensions.

It will be appreciated by those skilled in the art that, while the term ultrasonic is used throughout this specification, it is specifically contemplated that various other frequencies could be used with the embodiments described herein. In particular, oscillation at frequencies that would fall within the range of human hearing (e.g. sonic oscillation), or at frequencies that are even lower could also be used including pure P-type waves (pressure waves, also known as L-type or longitudinal waves) as well as S-type waves (shear waves, also know as T-type or transverse waves) or a combination of both types. Similarly, frequencies that are much higher than the frequencies typically characterized as ultrasonic (e.g. approximately up to 40,000 Hz) could also be used, according to the needs of the desired application.

Turning now to FIG. 1, there is provided a micro-machining apparatus 10 according to one embodiment. The micro-machining apparatus 10 can be used for working the surface of a workpiece by micro-machining in order to provide a desired surface finish to a surface of a workpiece by leaving desired profile features while removing finer undesired profile features.

The micro-machining generally first requires conversion of line voltage (e.g. 120 V or 220V at 60 Hz) to a high frequency electrical energy (e.g. 20,000 Hz) by use of a power converter (not shown) as is known in the art. This high frequency electrical energy is then provided to an ultrasonic transducer 12, which is connected to and supported by a support frame 14 in such a manner that the ultrasonic transducer 12 can move relative to the support frame 14. The ultrasonic transducer 12 is configured to generate oscillatory motion in a particular direction in response to the application of the electrical energy, as discussed in more detail below.

The ultrasonic transducer 12 is coupled to an amplifier, also known as a horn 16 at an upper portion 40 of the horn 16. The horn 16 also has a working end 44 that is coupled to a tool holder 18 or directly to a formable polishing tool 20. As shown in FIG. 1, the formable polishing tool 20 can be secured to a distal end 21 of the tool holder 18.

In some embodiments, the ultrasonic transducer 12 comprises a magnetoresistive actuator, having a ferromagnetic core that changes in length in response to a varying application of a magnetic field generated by use of the electrical energy in order to develop the desired oscillatory motion. In other embodiments, the ultrasonic transducer 12 comprises one or more piezoelectric elements that oscillate in response to the application of the electrical energy, as described in more detail below.

During use, the formable polishing tool 20 oscillates in response to the oscillation of the ultrasonic transducer 12 caused by the application of electrical energy. In some embodiments, the oscillation of the transducer 12 and the formable polishing tool 20 is primarily parallel to a longitudinal axis A of the working apparatus 10 as shown in FIG. 1. Generally, the ultrasonic transducer 12 is driven at a frequency near the resonant frequency of the transducer 12, horn 16, tool holder 18 and formable polishing tool 20, which tends to provide the desired amplitude response in the ultrasonic transducer 12 when converting the high frequency electrical energy into usable mechanical energy.

Figure 3:
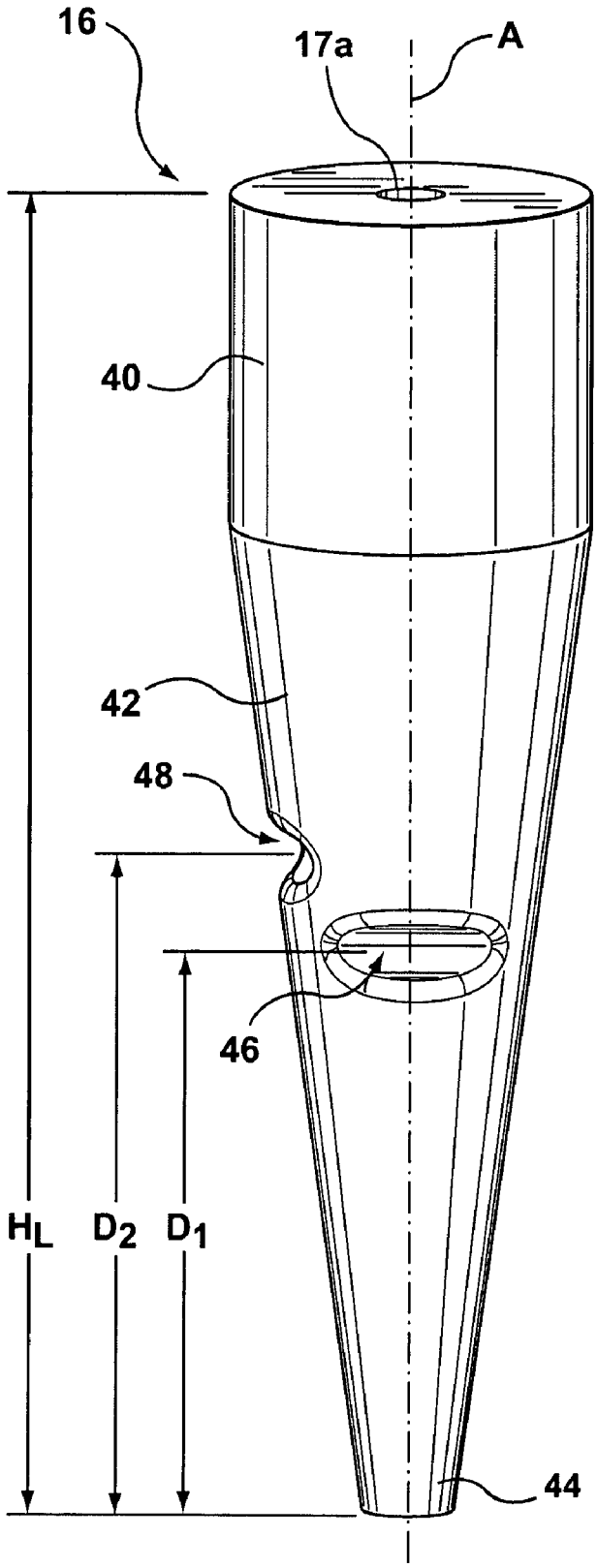
FIG. 3 is a perspective view of a horn for use in the micro-machining apparatus of FIG. 1.

The mechanical energy generated by the ultrasonic transducer 12 is then amplified and transmitted by the horn 16 to drive the formable polishing tool 20. As best shown in FIG. 3, in some embodiments the horn 16 has a generally frustoconical shape, with the longitudinal direction of the horn 16 generally in alignment with the longitudinal axis A of the micro-machining apparatus 10.

The horn 16 is generally wider or larger in diameter at the upper portion 40 where it is coupled to the ultrasonic transducer 12 and narrower in diameter at the working end 44 where it is coupled to the formable polishing tool 20. This change in size tends to magnify the amplitude of the oscillation of the ultrasonic transducer 12, providing for greater movement of the formable polishing tool 20 during operation.

It will be appreciated that the horn 16 can have various different configurations and need not be frustoconical in shape. For example, the horn 16 could have a generally stepped, conical, catenoidal, Fourier or exponential shape, or have a straight shape. It is generally desirable that the working end 44 of the horn 16 be of a smaller diameter (or cross section) than the upper portion 40 of the horn to facilitate amplification of the movement of the formable polishing tool 20 with respect to the ultrasonic transducer 12.

In some embodiments, the horn length $H_L$ of the horn 16 is chosen to be approximately $\lambda/2$ where $\lambda$ is the ultrasonic wave length within the horn material in order to provide an increased amplitude of the ultrasonic wave at the working end 44 of the horn. By contrast, if the horn length $H_L$ were selected such that the working end 44 of the horn were located at a node approximately equal to $\lambda/4$ or $3\lambda/4$, then there would be little to no motion at the working end 44 of the horn 16.

The horn 16 can be secured to the ultrasonic transducer 12 using various coupling mechanisms. For example, the upper portion 40 of the horn 16 can be permanently affixed to the ultrasonic transducer 12 by the use of welding, soldering, brazing or some other permanent or semi-permanent process. Alternatively, as shown in FIG. 1 the horn 16 can be removably secured to the ultrasonic transducer 12 using a first coupler 17. In some embodiments, the first coupler 17 comprises a threaded rod, which can be separate component or an integral part of one of the horn 16 and ultrasonic transducer 12. For example, the first coupler 17 may comprise a male threaded portion protruding from the transducer 12, which engages with a corresponding female threaded portion 17*a* located within the horn 16 (as shown in FIG. 3).

Figure 2:
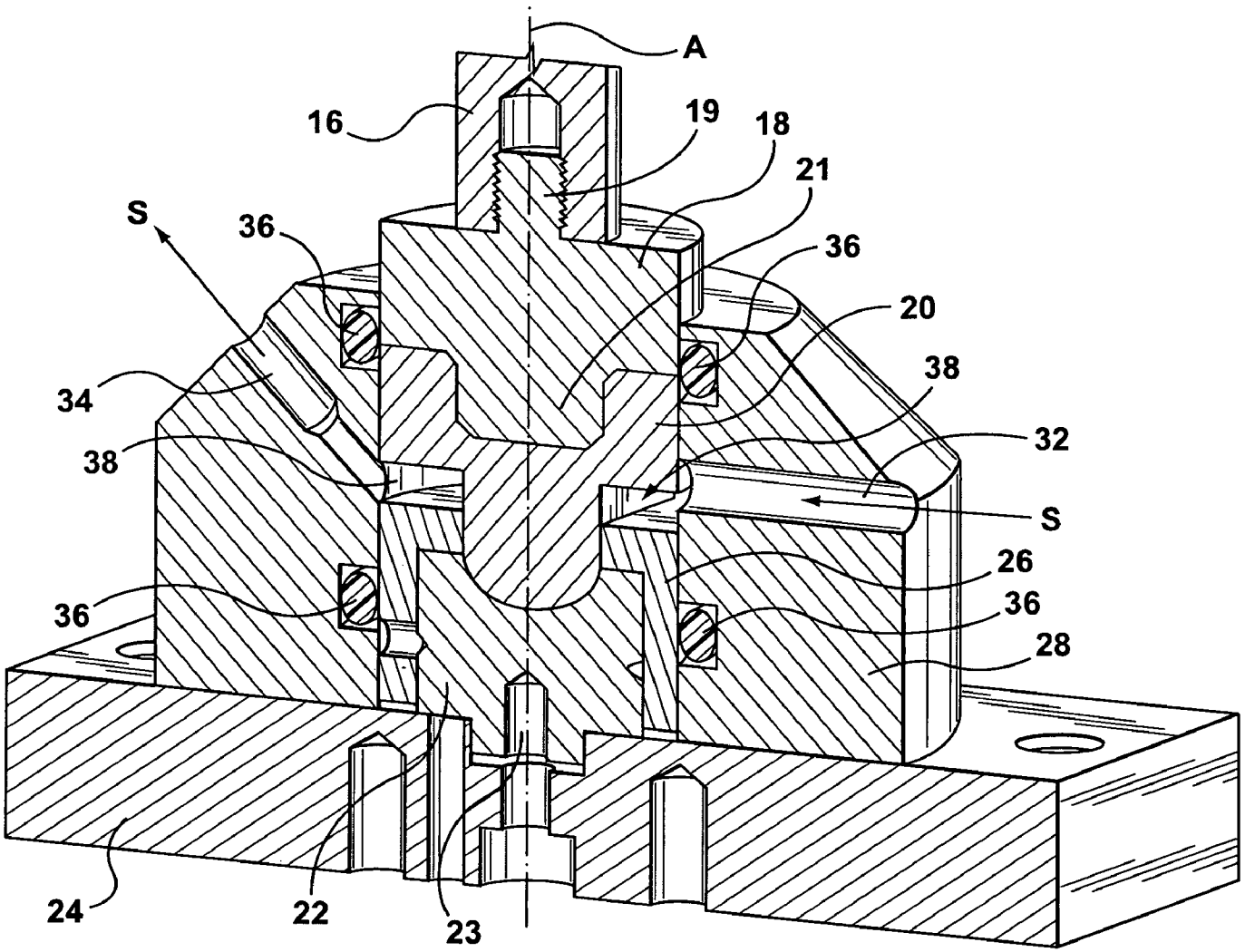
FIG. 2 is close-up view of the micro-machining apparatus of FIG. 1.
Figure 4B:
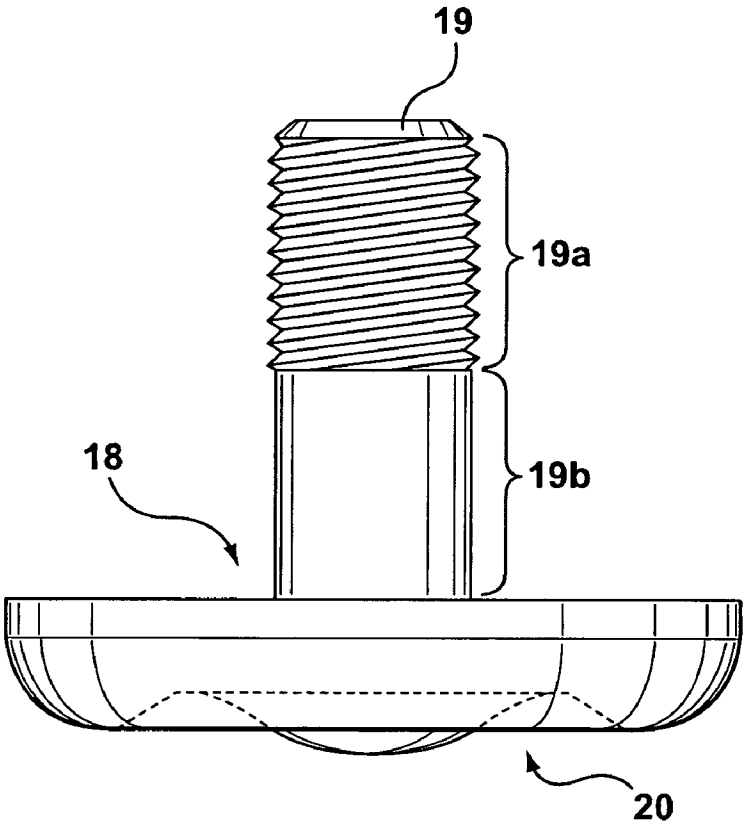
FIG. 4B is a side view of the tool holder and formable polishing tool of FIG. 4A.
Figure 4A:
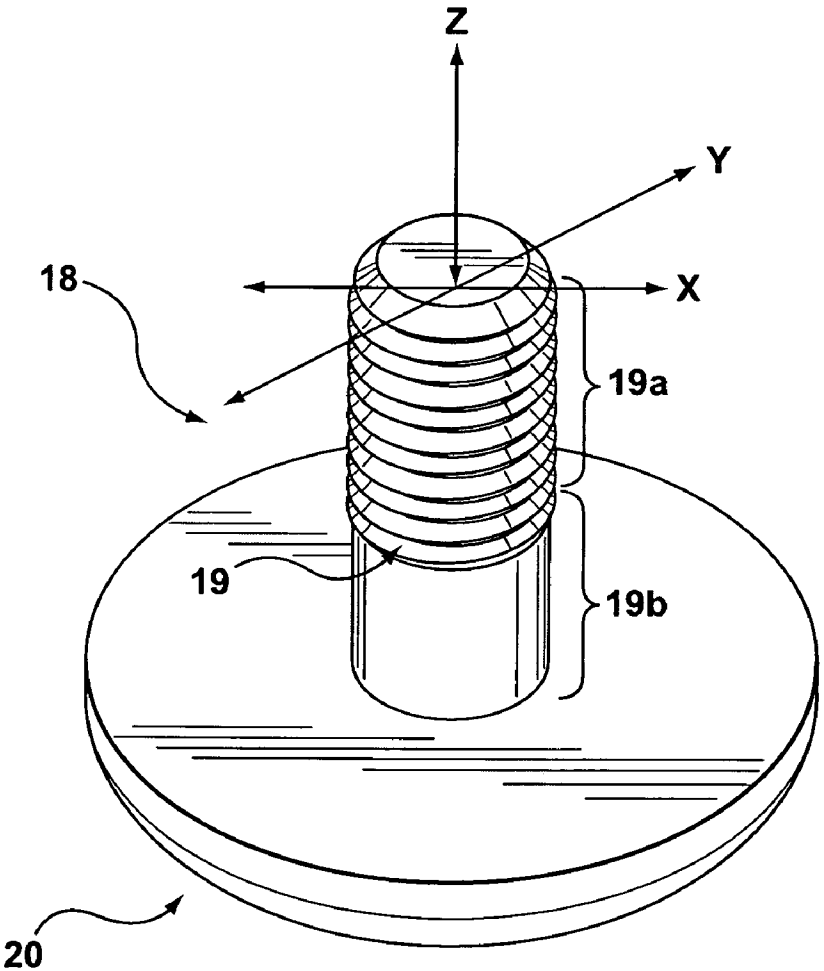
FIG. 4A is a perspective view of a tool holder and formable polishing tool for securing to the horn of FIG. 3.

Turning now to FIG. 2, the lower portion of the working apparatus 10 is shown in greater detail. The tool holder 18 is shown coupled to the horn 16. The tool holder 18 can be coupled to the horn 16 using various suitable techniques, including permanently by brazing, welding or soldering or by forming the tool holder 18 as an integral portion of the horn 16. Alternatively, as best shown in FIG. 2, the tool holder 18 can be removably secured to the horn 16, such as by using a second coupler 19, which could be a threaded connector. For example, as shown in FIGS. 4A and 4B, the tool holder 18 can be affixed to the second coupler 19 having a threaded portion 19*a* and a non-threaded portion 19*b*. When connected to the horn 16, the threaded portion 19*a* of the second coupler 19 can engage with a corresponding threaded portion on the inside of the working end 44 of the horn 16 to secure the tool holder 18 in place.

The formable polishing tool 20 can be mechanically secured to the holder 18 at the distal end 21 of the tool holder 18. This securing can be achieved in various ways, including permanent methods where the formable polishing tool 20 is actually an integral component of the tool holder 18 and is formed on the tool holder 18 or where the formable polishing tool 20 is part of the horn 16. Alternatively, the formable polishing tool 20 can be secured by other suitable techniques, such as by welding, brazing or soldering the formable polishing tool 20 to the holder 18, or by the use of an adhesive. In other embodiments, the formable polishing tool 20 can be mechanically secured to the holder 18 in a removable fashion, such as by threading the formable polishing tool 20 onto the holder 18.

Figure 4C:
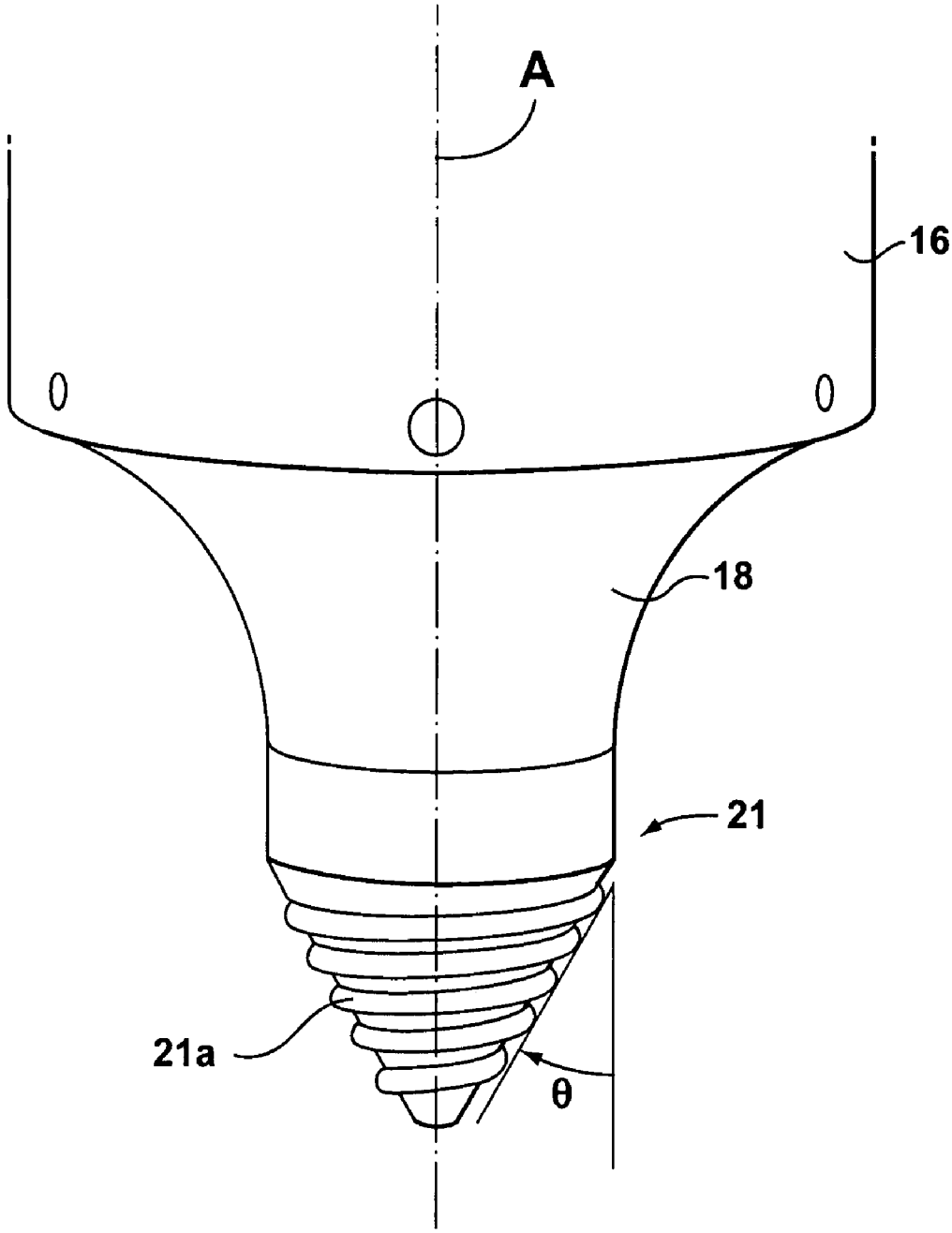
FIG. 4C is a side view of a horn having an integrated tapered threaded portion according to one embodiment.

In some embodiments, as shown in FIG. 4C, the horn 16 can be provided with a tapered threaded portion 44*a* located at the working end 44 of the horn 16. This tapered threaded portion 44*a* can assist in providing efficient transmission of mechanical energy from the horn 16 to the formable polishing tool 20. The tapered threaded portion 44*a* can have various different angles as indicated by θ (measured from a line parallel to the longitudinal axis A). For example, in some embodiments, θ can be approximately 45 degrees, while in other embodiments, θ can be approximately 30 degrees or approximately 60 degrees. During forming of the formable polishing tool 20, the formable polishing tool 20 can be solidified over this tapered threaded portion 44*a*, which tends to reduce the effect of thermal contraction on the bond strength between the formable polishing tool 20 and the horn 16. Furthermore, the tapered thread portion 44*a* will tend transmit the ultrasonic energy from the transducer 12 in a divergent way through the formable polishing tool 20. This can assist in preventing premature degradation of the formable polishing tool 20 and horn 16 or holder 18 polymer-metal interfaces. In some embodiments, the threads of the tapered threaded portion 44*a* could have either a sharp triangular or rounded edge profile.

In addition, when the formable polishing tool 20 is molded on the surface of the horn 16, the surface of the horn 16 could first be textured such as by sand blasting, chemically etching or in other ways to enhance the bond strength of the interface and efficiency of energy transmission through the interface between the formable polishing tool 20 and the horn 16.

As best shown in FIG. 2, during use the formable polishing tool 20 is engaged with a workpiece 22. The workpiece 22 rests on and is secured to a workplate 24. In some embodiments, the workpiece can be secured to the workplate 24 by a coupler 23, which can comprise cooperating threaded portions. In other embodiments, the workpiece 22 can be secured to the workplate 24 via an electromagnet or other suitable securing structure.

Figure 9:
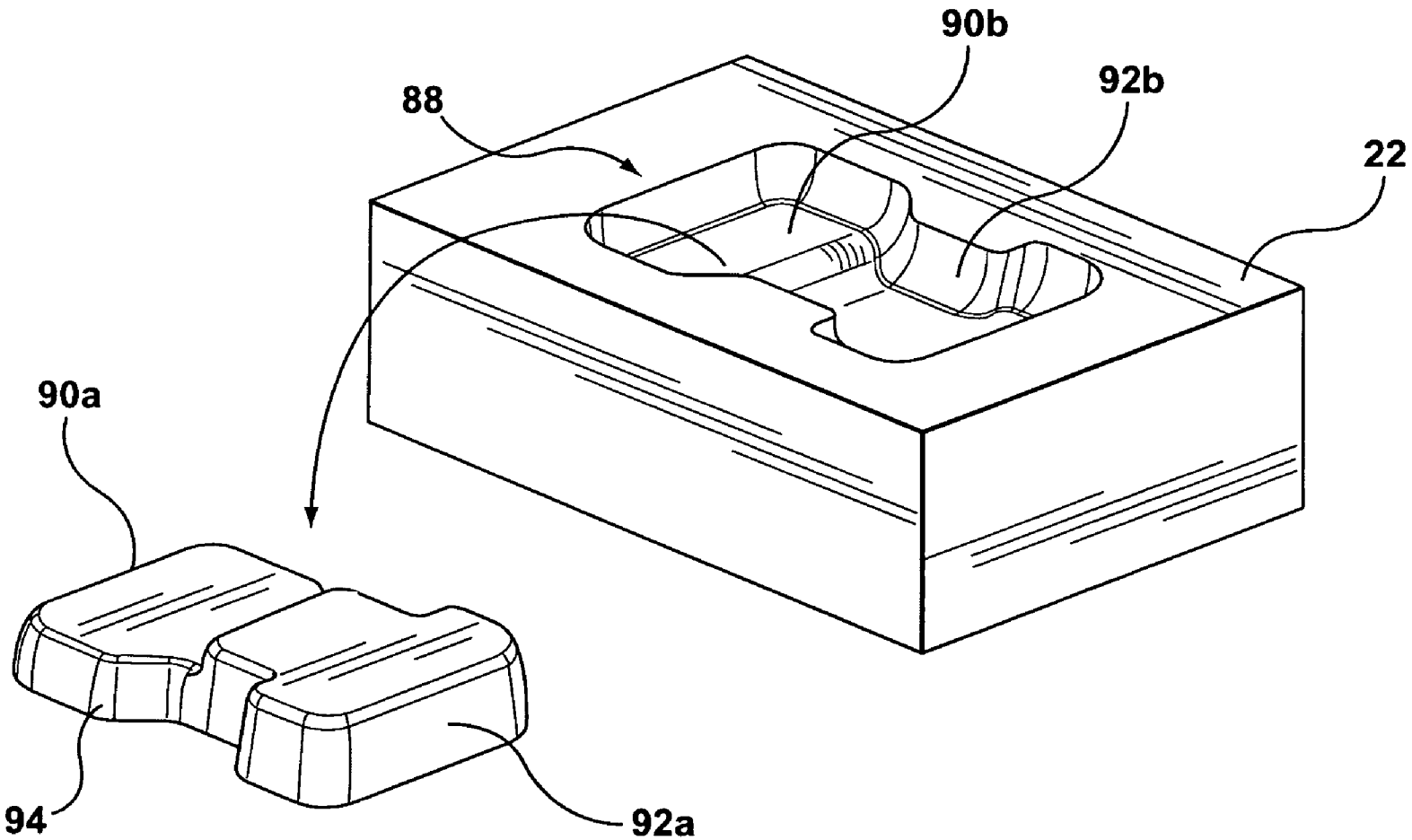
FIG. 9 is a perspective view of a component formed using a workpiece made using the micro-machining apparatus of FIG. 1.

According to some embodiments, the workpiece 22 can be a mold or other similarly shaped object that is to be micro-machined using the working apparatus 10. In some embodiments (as best shown in FIG. 9), the workpiece 22 can have a generally concave opening 88 in the top surface adapted to receive a protruding profile on the formable polishing tool 20. In other embodiments, the workpiece 22 can have a generally convex shape adapted to mate with a corresponding concave formable polishing tool 20. In some embodiments, the workpiece 22 can have a combination of one or more concave and convex portions.

In some embodiments, the lower portion of the micro-machining apparatus 10 also generally includes an abrasive chamber 28 surrounding the workpiece 22 for providing abrasive slurry S used during micro-machining of the workpiece 22. During use, the formable polishing tool 20 and workpiece 22 are generally provided within a cavity 38 as defined by the inner walls of the abrasive chamber 28.

In some embodiments, portions of the workpiece 22 where no micro-machining is desired are protected from the action of the slurry S and the formable polishing tool 20 by a protective plate 26 which has an opening in the top portion for receiving the formable polishing tool 20 and is sized to match the outer perimeter of the cavity 38. The protective plate 26 keeps the formable polishing tool 20 and the slurry S from micro-machining or otherwise damaging those portions of the workpiece 22 where micro-machining is not desired.

The abrasive chamber 28 includes a slurry inlet 32 for receiving clean slurry S and for providing the clean slurry S into the cavity 38 where it can be used during micro-machining. The abrasive chamber 28 also includes a slurry outlet 34 for removing slurry S from the cavity 30 after it has been contaminated by particulates generated during the micro-machining process.

During use, the abrasive slurry S operates to permit abrasive particles to pass to the cavity 38, to promote the removal of the wear products from the cavity 38 and to provide fresh abrasive particles having the correct sizing, as described above. The slurry S may also assist in cooling the formable polishing tool 20 and workpiece 22 during the micro-machining process. The abrasive in the slurry S also provides the acoustic link between the formable polishing tool 20 and the workpiece 22 to effect micro-machining of the workpiece 22.

The abrasive chamber 28 also includes sealing rings 36, which are typically O-ring seals made of silicone, BUNA-N, viton, other types of elastomeric material or even soft metals. The sealing rings 36 are situated between the inner walls of the abrasive chamber 28 and the protective plate 26, and help prevent leakage of slurry S from the chamber 38 during use while minimizing absorption of ultrasonic energy.

Turning now to the formable polishing tool 20 itself, in some embodiments, the formable polishing tool 20 can be made from one or more portions or layers of single material components, such as a thermoformable material (which may include thermoplastic polymers, some thermosets and some metals) as well as other thermoset materials, metals or ceramics. In other embodiments, the formable polishing tool 20 can be made of a composite comprising a matrix material and reinforcement material. The use of a reinforcement material tends to make the formable polishing tool 20 more resistant to mechanical stresses induced by resonant vibration and to promote efficient propagation of the acoustic waves generated by the horn 16. The matrix material can be any suitable material, such as a polymer of either thermoplastic or thermosets type, a metal or a ceramic.

The formable polishing tool 20 can also be formed with an electrically conductive composite material, which may include a polymer composite having graphite powder or copper powder as filler. Having an electrically conductive composite formable polishing tool 20 allows the formable polishing tool 20 to be used to perform an EDM process as well as an ultrasonic micro-machining process. For example, as described below with respect to FIG. 16, an EDM process could be combined with an ultrasonic micro-machining process within the same apparatus 10, using the same formable polishing tool 10 either alternately or even simultaneously in order to take advantage of the benefits provided by each processes.

In some embodiments, the reinforcement material provides the formable polishing tool 20 with a harder surface. In another embodiment, the reinforcement material provides the formable polishing tool 20 with improved thermal conductivity. In one exemplary embodiment, a 90% by volume polystyrene thermoplastic matrix is used with a 10% by volume of aluminum oxide ceramic as a reinforcement material and as a promoter for more efficient acoustic energy transmission. In other embodiments, a silicon carbide reinforcement and abrasive material can be used within a soft silicon elastomeric material.

In some embodiments, certain thermoset polymers could be used which can have properties that are similar to thermoplastics. For example, low-molecular-weight PBT oligomers are thermoplastic forms of polyester that require a chemical reaction to polymerize (like a thermoset), but which can be melted much like a thermoplastic material up to a certain temperature before turning into a regular polyester thermoset.

In some embodiments, a low melting point metal alloy could be used to form the formable polishing tool 20. For example, much like polymers, low melting point alloys such as Cerrolow-117 bismuth alloy (44.7% Bi, 22.6% Pb, 8.3% Sn, 5.3% Cd, 19.1% In) with a melting point as low as 48 degrees Celsius could be used as the formable polishing tool 20.

In some embodiments, the formable polishing tool 20 can include a portion or layer made of one or more thermoplastic polymers, such as polyethylene (LDPE, HDPE, UHMWPE), polypropylene, nylon, PEEK and others. In some embodiments, additives such as a 20% solid filler can be added (e.g. alumina powder or grain, aluminum powder or grain, wood powder, carbon black powder, silicon powder or black or green silicon carbide abrasives powder or grain) to the polymer to control one or more of the rigidity of the polymer, the thermal conductivity and speed of sound in the material. In some embodiments, 3-7 mm long fibers or whiskers (such as fiber glass, carbon or even wood) can be added to control the strength of the formable polishing tool 20.

In some embodiments, it is desirable to match the speed of sound between horn 16 and the formable polishing tool 20, as this tends to promote efficient transmission of the sound or mechanical energy. Thus, providing additives in a formable polishing tool 20 made of thermoplastic materials could be used to "tune" the frequency response of the formable polishing tool 20 as desired.

The formable polishing tool 20 can be formed using several different techniques. In some embodiments, the formable polishing tool 20 has at least a portion or layer that is made of a moldable material which can transition from a formable state, wherein the formable polishing tool 20 is pliable and can be molded or shaped by the application of sufficient pressure, to a solid state wherein the formable polishing tool 20 is solid and resists molding or shaping.

The transition from the formable state to the solid state can be accomplished in a different manner according to the nature of the moldable material. For example, if the moldable material is a thermoformable material, such as a thermoplastic, then the material can be placed into the formable state by heating the material to a sufficient first temperature above the glass-transition temperature of the polymer. The material can then be solidified by cooling the material down to a second temperature below the glass transition temperature of the polymer. In other embodiments, where a thermoformable low melting point metal alloy is used to form the formable polishing tool 20, the transition from formable state to solid state would occur in the vicinity of the melting point or Solidus-Liquidus point of the formable polishing tool 20 instead of glass transition temperature for polymers. Thus, the material would be provided in a formable state above the melting point and then cooled to the solid state below the melting point.

In other embodiments, where the material used is a thermoset, the material can solidify by operation of a chemical reaction, such as by cross-linking polymerization. To effect solidification, it may be necessary to heat the thermoset to trigger cross-linking and obtain the solid state. In other embodiments, the material may include a resin and a filler, which solidify upon mixing to change from the formable state to the solid state.

Figure 5:
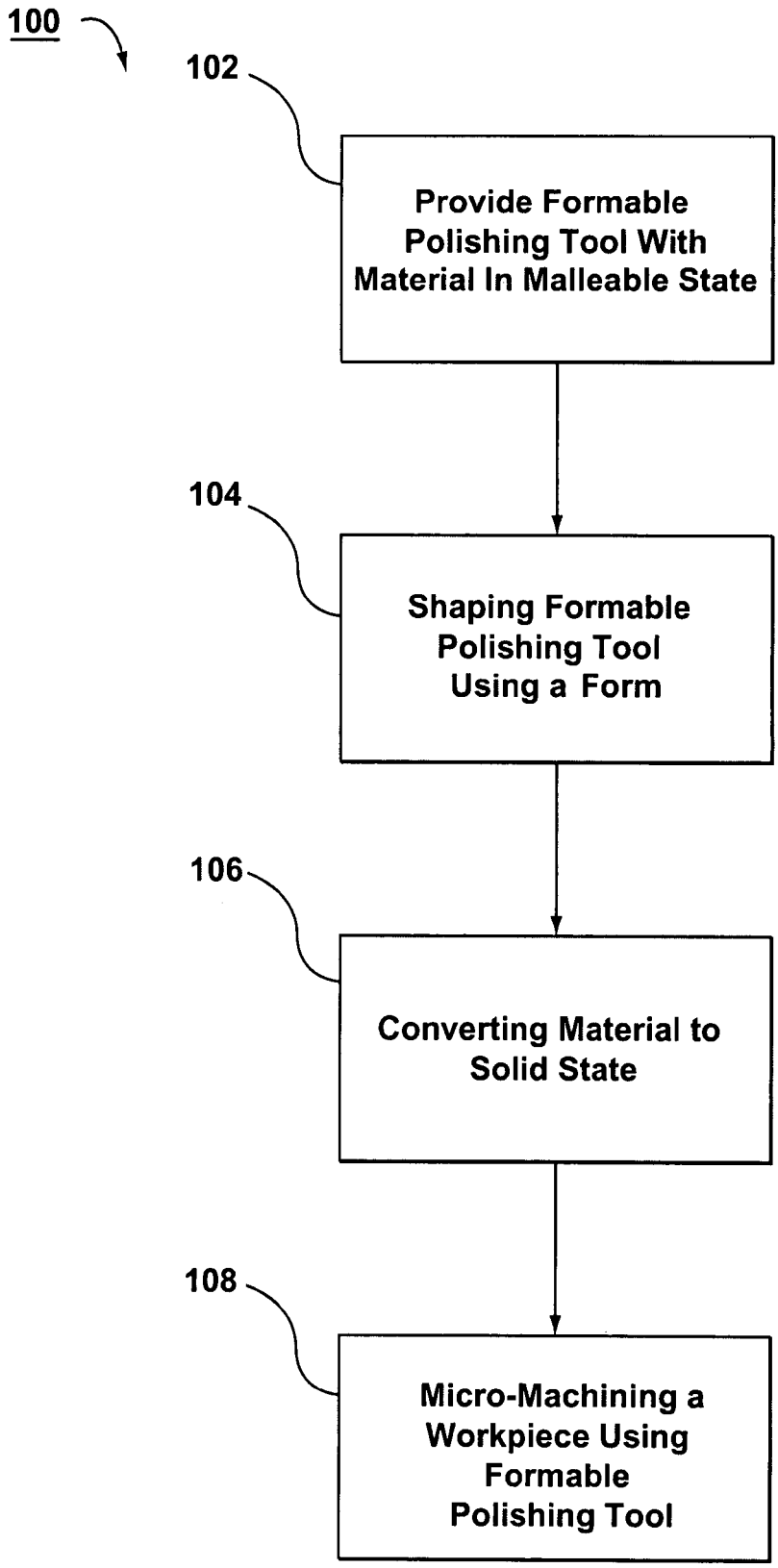
FIG. 5 is a schematic representation of a method of forming a formable polishing tool for use with the micro-machining apparatus of FIG. 1.

One method 100 of shaping the formable polishing tool 20 is shown generally in FIG. 5. At 102, the formable polishing tool 20 is provided having a portion that is in a formable state. As described generally above, this may involve heating the formable polishing tool 20 to a certain temperature, or providing a mixture at a certain chemical stage.

At 104, the formable polishing tool 20 is then shaped using a form. According to some embodiments, the formable polishing tool 20 can be shaped by pressing the formable polishing tool 20 against a form while the formable polishing tool 20 is in the formable state and is malleable or pliable. In some embodiments, the form is the workpiece 22 that is to be polished. In other embodiments, the form is a model or replica of all or a portion of the desired shape of the workpiece 22. Since the formable polishing tool 20 is in a formable state and is malleable, when sufficient pressure is applied the formable polishing tool 20 will acquire a shape or profile that is complementary to the form that the formable polishing tool 20 is being pressed against. In other embodiments, the formable polishing tool 20 can be cast from a liquid material using the form at 104.

At 106, the formable polishing tool 20 is transitioned from the formable state to the solid state. In some embodiments, this may involve cooling the formable polishing tool 20 below the glass transition temperature or effecting a chemical reaction (such as cross-linking of a thermoset) while the formable polishing tool 20 is held in place against the form. In some embodiments, the formable polishing tool 20 material is sufficiently viscous even in the formable state that once the desired complementary profile has been achieved, the formable polishing tool 20 can be removed from the form before the transition to the solid state occurs.

At 108, the formable polishing tool 20 has achieved the solid state, and the formable polishing tool 20 is used for micro-machining of the workpiece 22.

According to some embodiments, dimensional contraction of the formable polishing tool 20 occurs during the transition from the formable state to the solid state. This contraction generates a slight difference in the profile geometry of the formable polishing tool 20 and the form used to form the formable polishing tool 20. This slight difference functions as a void space or gap between the formable polishing tool 20 and the workpiece 22 during operation. During micro-machining, this void space can be filled with the abrasive slurry S to effect the micro-machining of the workpiece 22.

In some embodiments, the size of the gap or void space that is generated by the dimensional contraction of the formable polishing tool 20 may not be sufficiently large for a particular application. In such cases, the size of the gap or void space can be increased by using a secondary process to reshape the formable polishing tool 20. This may be necessary, for example, when the size of the gap is small compared to the abrasive particle size that will be used in a particular micro-machining process or when the workpiece 22 has re-entrant surface features which require such secondary process to inhibit the formable polishing tool 20 from mechanically interfering, seizing or becoming clamped onto the workpiece 22.

Figure 6A:
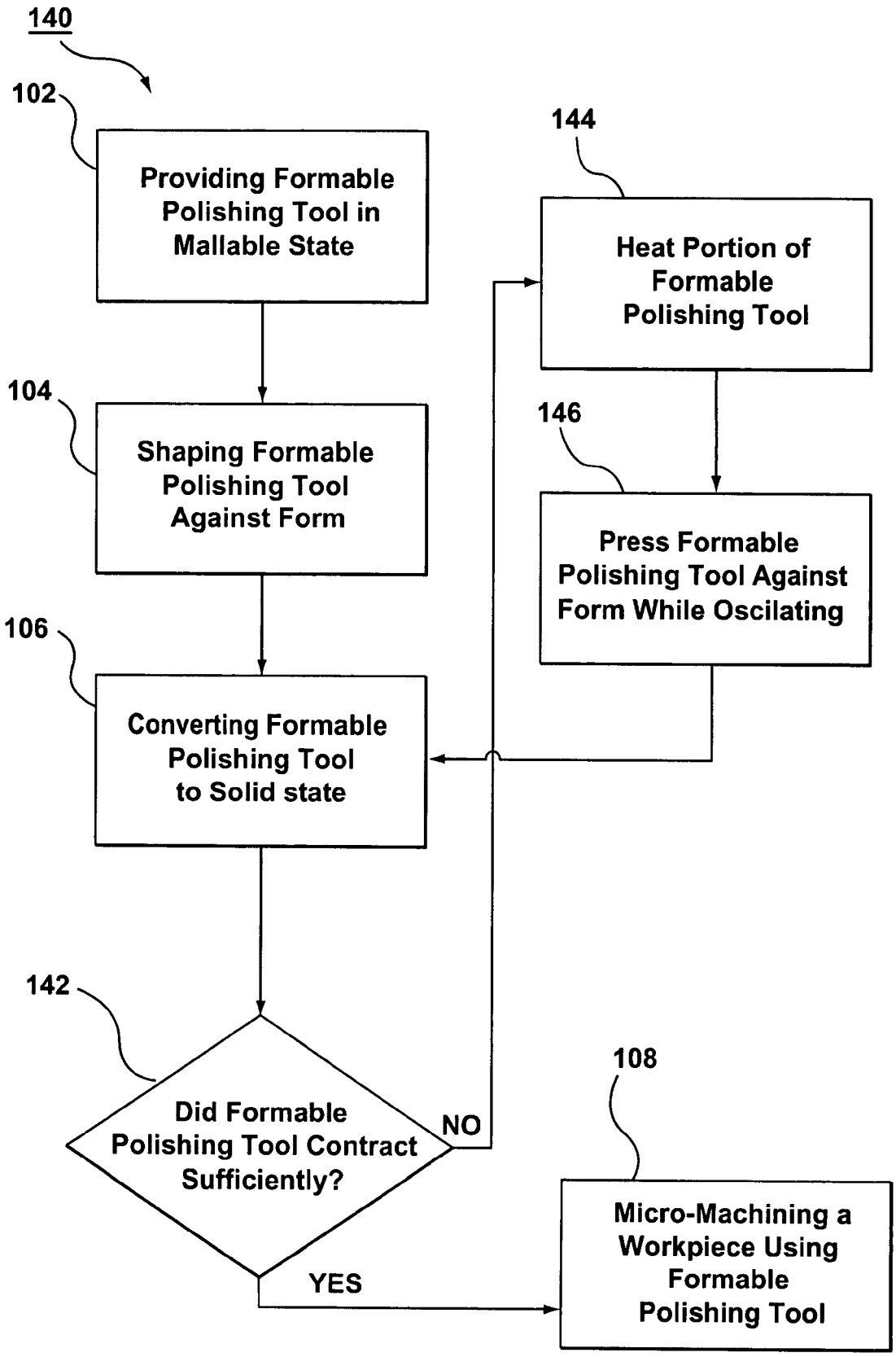
FIG. 6A is a schematic representation of a method for forming a formable polishing tool using a secondary process to adjust the shape of the formable polishing tool.

A method 140 of performing the secondary process is described generally with reference to FIG. 6A as a variation of the method 100 shown in FIG. 5. The method 140 proceeds as method 100 at 102 by providing the formable polishing tool 20 in a formable state, at 104 by shaping the formable polishing tool 20 against a form, and at 106 by converting the formable polishing tool 20 to the solid state.

At 142, a determination is made as to whether the formable polishing tool 20 has contracted enough to achieve the desired dimensions to provide a sufficient gap or void for use in micro-machining the workpiece 22. If the formable polishing tool 20 has the desired dimensions, then the method 140 can proceed to 108 where micro-machining of the workpiece 22 will occur.

However, if the formable polishing tool 20 did not contract a sufficient amount, then the method 140 proceeds to 144, where a portion of the formable polishing tool 20 is returned to the formable state.

Figure 6B:
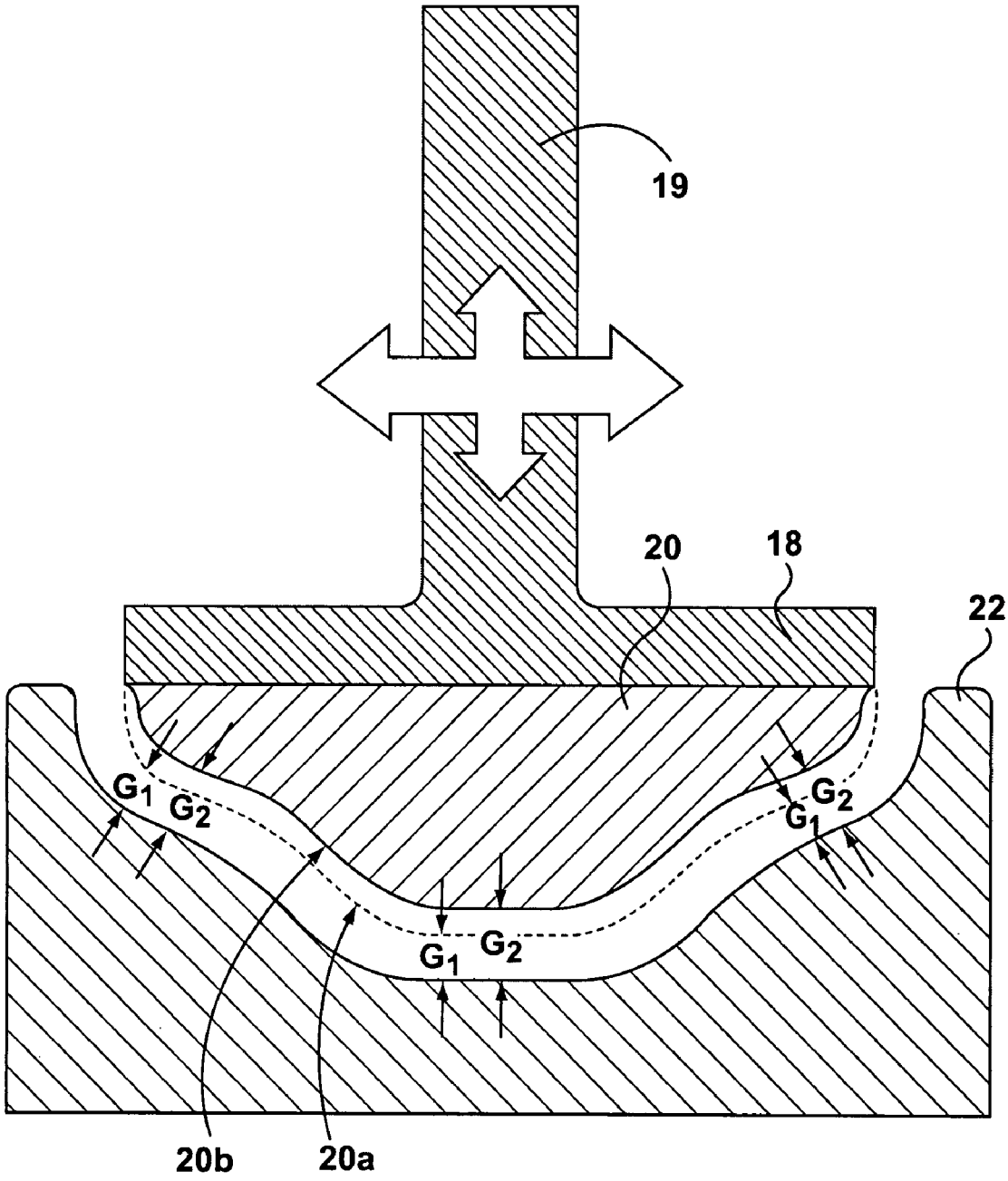
FIG. 6B is a cross-sectional view of a formable polishing tool formed using the secondary process described in FIG. 6A.

For example, as shown in FIG. 6B, the formable polishing tool 20 could be formed of a composite thermoplastic having a polystyrene matrix and alumina as a reinforcement material. Once the composite formable polishing tool 20 has been shaped at 106, it will have a first surface profile indicated generally as 20*a*. This first surface profile 20*a* generally provides for a first gap width $G_1$ between the first surface profile 20*a* and the workpiece 22 caused by the thermal contraction of the formable polishing tool 20. If at 142 it is determined that the first gap width $G_1$ is not sufficiently large, then the formable polishing tool 20 can be exposed to radiant heat at 144 in order to soften the outer portion or layer to modify the first surface profile 20*a* of the formable polishing tool 20. Alternatively, the formable polishing tool 20 could be pressed against the workpiece 22 or a form that has been preheated to a temperature in the vicinity of the specific glass transition temperature of that polymer.

At step 146, the formable polishing tool 20 having again adopted the formable state, the first surface profile 20*a* of the formable polishing tool 20 can now be reshaped to have a smaller second surface profile indicated generally as 20*b*. In some embodiments, this shaping can be done once the outer layer of the formable polishing tool 20 has been heated to acquire a sufficient malleability by inserting the formable polishing tool 20 into the form (e.g. either the workpiece 22 itself or a replica of the workpiece). For example, as the formable polishing tool 20 transitions to the solid state (e.g. is allowed to cool), a 3D motion (such as an orbital or other oscillatory motion) of known predetermined amplitude can be imposed on the formable polishing tool 20. This causes an interference between the surface of the formable polishing tool 20 and the workpiece 22 or the form, increasing the pressure against the surface of the formable polishing tool 20, and forming the second surface profile 20*b* with slightly smaller dimensions, in proportion to the amplitude of the 3D motion that was imposed. As shown in FIG. 6B, the slightly smaller second surface profile 20*b* provides for a second gap width of $G_2$ between the formable polishing tool 20 and the workpiece 22, that is generally larger than $G_1$.

It will of course be appreciated that to use the secondary process according to method 140, the formable polishing tool 20 must be made of a material that can be returned from solid state to a formable state. Thus, a formable polishing tool 20 made of one or more thermoformable materials (such as a thermoplastic polymer) that can be softened by application of heat can be used with this method 140. However, a formable polishing tool 20 made of other materials, such as certain thermoset polymers, may not be capable of easily returning to the formable state, and thus may not be suitable for use with method 140.

In an alternative embodiment, however, it may be possible to incorporate the secondary process of method 140 by applying 3D motion during the initial forming of the formable polishing tool 20. This can allow for greater control over the contraction of the formable polishing tool 20 during the initial forming stage, and can allow a secondary process to be used where the formable polishing tool 20 is made of additional materials, including thermoset polymer materials.

According to some embodiments, the formable polishing tool 20 can be formed using a multi-step process. In such embodiments, the formable polishing tool 20 can be initially molded from basic material in fine powder form which is mixed by dry tumbling and then compression molded into a rough form as a powder mixture, typically at low pressures of less than 2500 psi. In such embodiments, the rough form of the formable polishing tool 20 can then be subjected to one or both of method 100 and method 140 in order to achieve the desired final profile of the formable polishing tool 20.

Once the formable polishing tool 20 has been shaped using one or more of the methods described above, micro-machining of the workpiece 22 can begin. When the form used to shape the formable polishing tool 20 was the workpiece 22, this may require removing the formable polishing tool 20 from the cavity 30 once shaping is complete and then inserting the protective plate 26 over the workpiece 22. Alternatively, in some embodiments the protective plate 26 may be present during the forming of the formable polishing tool 20. Abrasive solution or slurry S is then added or injected into the cavity 38 and/or onto the workpiece 22, and micro-machining can begin. The formable polishing tool 20 is then inserted back into the cavity 38 down to a predetermined depth. In some embodiments, this depth is controlled by adjusting the height of support frame 14 relative to the workplate 24, which can be done by adjusting one or both of the support frame 14 and workplate 24. This adjustment can provide the desired gap width between the face of the formable polishing tool 20 and the surface of the workpiece 22, allowing the abrasive slurry S to generally disperse evenly in the gap between the formable polishing tool 20 and the workpiece 22.

The ultrasonic transducer 12 is then actuated at a desired frequency (typically in between 20,000 and 40,000 Hz) and a desired oscillation amplitude to cause a mechanical motion of the formable polishing tool 20 with respect to the workpiece 22 that is generally normal to the surface of the workpiece 22 and along longitudinal axis A, effecting micro-machining of the workpiece 22.

In some embodiments, during micro-machining, fresh abrasive slurry S can be added to the cavity 38 by pumping the slurry S through the slurry inlet 32. The slurry S can then pass into the cavity between the protective plate 26 and the surface of the formable polishing tool 20, where it can then pass over the top edges of the formable polishing tool 20 to infiltrate in the gap between the formable polishing tool 20 and the workpiece 22.

In some embodiments, once a desired amount of micro-machining has been performed, the formable polishing tool 20 can be removed from the cavity 38, and the abrasive size (or grade) and/or the type of the abrasive in the slurry S is changed. Typically, as the micro-machining process proceeds, finer grade abrasive particles are substituted for the earlier rougher (larger) grade particles, which may be accompanied by a corresponding adjustment in the gap size. Rougher particles in the slurry S can be removed by using various methods, including using jets of air, water or an oil-water emulsion directed into the cavity 30 or ultrasonic fluidized bed techniques to flush out the particles. Micro-machining can then continue using the finer grade slurry.

Figure 7:
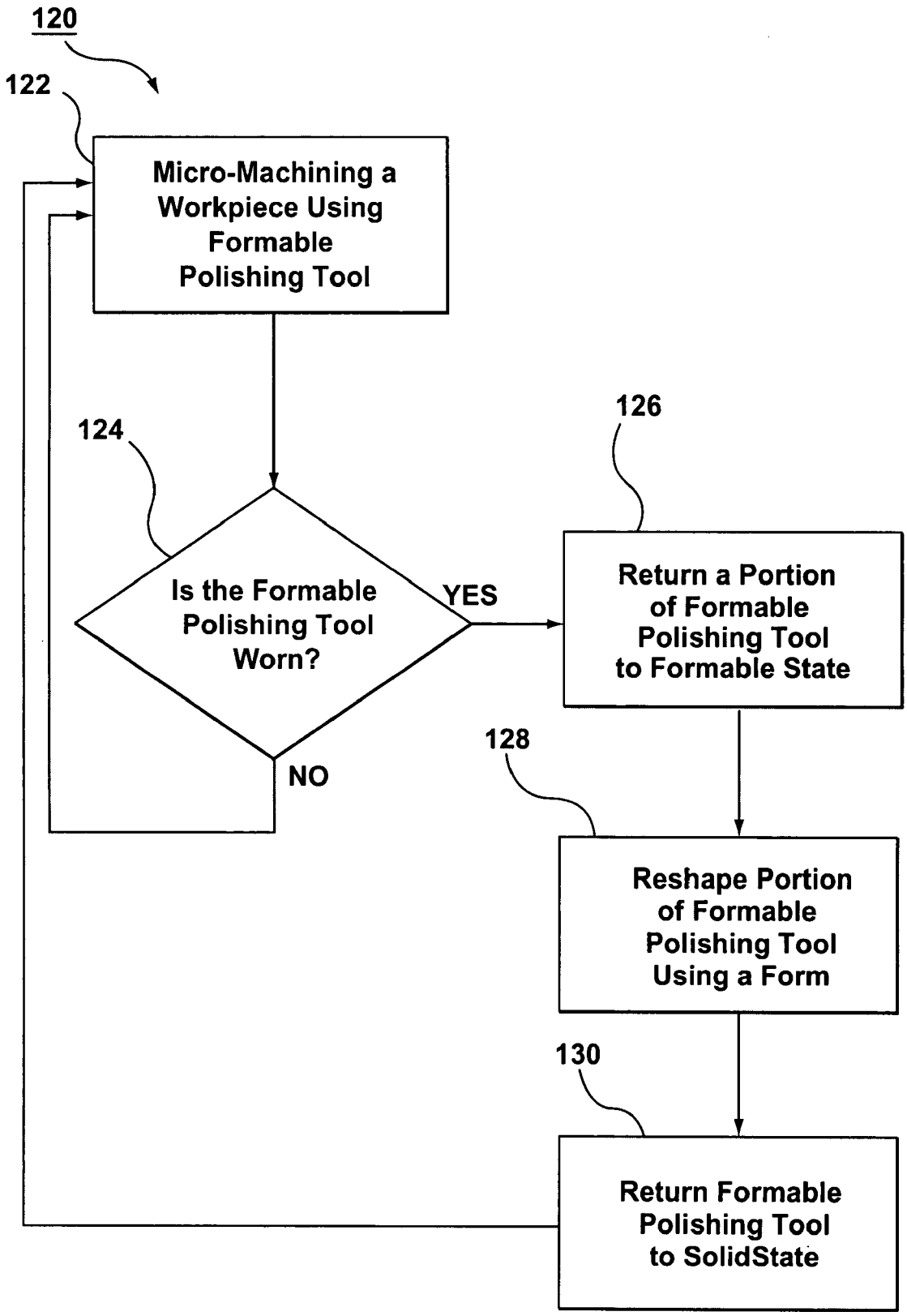
FIG. 7 is a schematic representation of a method of reforming a formable polishing tool.

In some embodiments, as discussed with reference to FIG. 7, the formable polishing tool 20 can be reshaped or reformed at a break in micro-machining using method 120. This can be done, for example, when it is determined that the formable polishing tool 20 is sufficiently worn that it is no longer providing a sufficiently accurate profile as needed to effect the desired micro-machining of the workpiece 22.

According to method 120, at 122 the workpiece is being polished using a formable polishing tool 20. At some stage, such as during a change in the slurry S, after one or more workpieces have been completed, or otherwise at some point during the micro-machining process, a determination is made at 124 as to whether the formable polishing tool 20 is sufficiently worn such that it should be reformed or redressed. If no redressing is needed, then the method 120 returns to 122, and micro-machining can continue.

However, if redressing of the formable polishing tool 20 is required, then the method 120 proceeds to 126, where a portion of the formable polishing tool 20 is returned to the formable state. This can be done, for example, by heating a portion of a polymer formable polishing tool 20 above the glass transition temperature of the polymer.

At 128, a portion of the formable polishing tool 20 can then be reformed using the form when the formable polishing tool 20 is in the formable state. In some embodiments, such as where the formable polishing tool 20 is made of a thermo-formable material (e.g. a thermoplastic polymer), this is done by pressing the formable polishing tool 20 against the form to reshape the formable polishing tool 20 to the desired shape. As with method 100 described above, the form can be the workpiece 22 itself or a replica thereof. Furthermore, as with method 140, the formable polishing tool 20 can be optionally provided with a 3D motion during forming at 128 to achieve the desired formable polishing tool 20 dimensions.

At 130, the formable polishing tool 20 is then returned to the solid state. In some embodiments, whether the formable polishing tool 20 comprises a thermoplastic polymer, this will generally be done by cooling the formable polishing tool 20 to a temperature below the glass transition temperature of the polymer. The formable polishing tool 20 will have returned to the desired surface profile, and micro-machining of the workpiece can resume at 122.

Reworking of the formable polishing tool 20 in this manner allows the profile of the formable polishing tool 20 to be kept as close as possible to the desired profile of the workpiece 22 to provide a predictable and uniform surface finish. Furthermore, such reworking can allow the formable polishing tool 20 to be adjusted for changes in the surface of the workpiece 22 during micro-machining in the event that the workpiece 22 changes during micro-machining. Furthermore, in some embodiments, particulates in the abrasive slurry S might stick to the surface of the formable polishing tool 20 and could be difficult to remove when the abrasive grit size is being changed for a finer grade. Reworking the formable polishing tool 20 may allow for easier removal of the particulates or alternatively may allow any such particulates to be merged within the formable polishing tool 20 matrix by reworking the formable polishing tool 20.

In some embodiments, once the undesired waviness of the surface of the workpiece 22 has been removed, such waviness should not appear on the formable polishing tool 20 since only the desired surface features should be used to form the surface of the formable polishing tool 20 for even micro-machining to occur.

Micro-machining using a formable polishing tool 20 in this manner can continue until the desired surface finish is obtained. In some embodiments, by polishing or micro-machining in this manner it is possible to achieve a surface finish in the range of 0.05 to 0.01 μm Ra, which is a mirror surface finish.

Figure 8A:
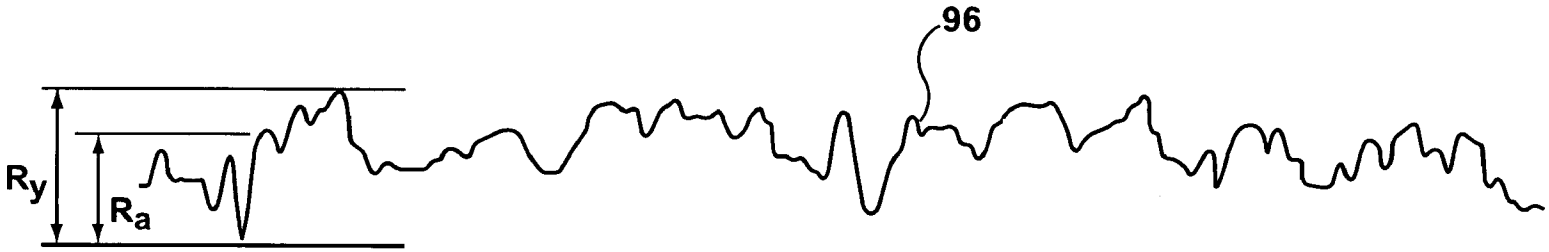
FIG. 8A is a profile view of a surface finished using a ultrasonic micro-machining process.
Figure 8B:
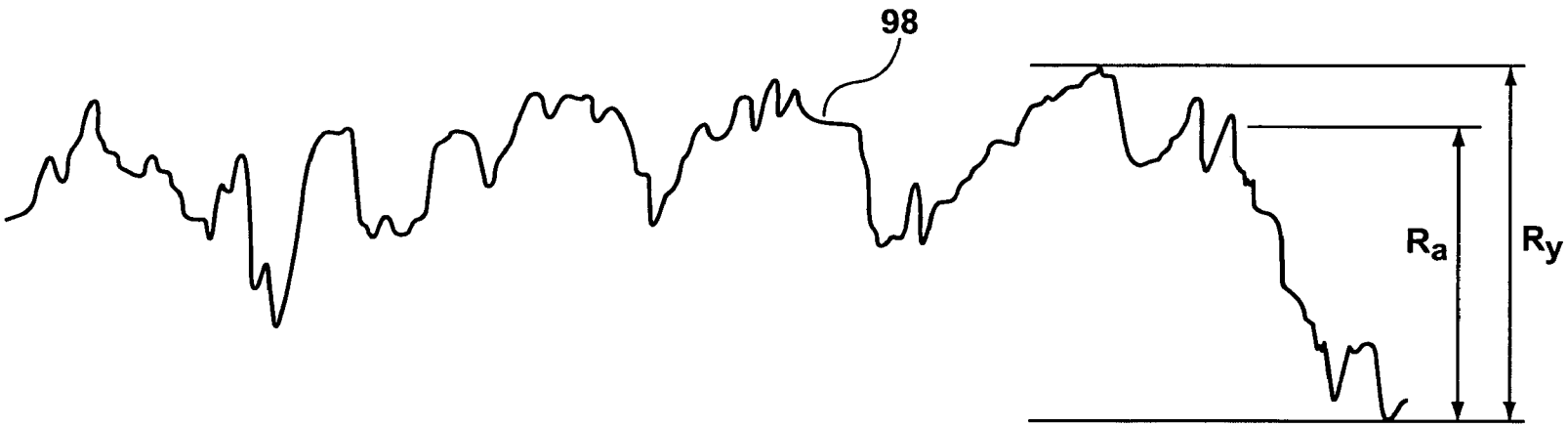
FIG. 8B is a profile view of a surface finished without using an ultrasonic micro-machining process.

For example, as shown in FIGS. 8A and 8B, the use of the ultrasonic micro-machining apparatus 10 can provide for a much smoother surface finish than using other methods. Profile 96 in FIG. 8A shows an exemplary profile provided by an ultrasonic micro-machining processes, having relatively smooth peaks and valleys characterized by a low $R_y$ (maximum peak to valley value) and $R_a$ (arithmetic mean value). In profile 96, some undesired surface features have been removed, while desired surface features have been retained. By contrast, profile 98 in FIG. 8B shows a surface that has been machined without the use of ultrasonic micro-machining, having much greater $R_y$ and $R_a$ values.

Since the type of abrasive grade, the hardness of the formable polishing tool 20 and the piezoelectric action can be adjusted as desired, this process is not limited to merely a polishing process, and machining, including significant rates of material removal, can be achieved with the right combination of abrasive grade, formable polishing tool 20 material, vibration frequency and amplitude and formable polishing tool-workpiece gap width.

According to one embodiment, standard abrasive solutions (such as oil-based or water-based solutions, alumina, silicon carbide, diamond and others) can be used with a formable polishing tool 20 and workpiece 22 where the gap between the formable polishing tool 20 and the workpiece 22 is in the range of 1 to 10 times the abrasive grain size. In some embodiments, the viscosity of the abrasive solution might be increased to promote material removal rate by adding a long chain polymeric solution, such as poliox.

In some embodiments, material removal from the workpiece 22 can be further promoted by putting the formable polishing tool 20 directly in contact with the workpiece 22 during polishing. The hammering or rubbing action of the formable polishing tool 20 acting directly against the workpiece 22 could promote increased material removal, which could be beneficial, for example, to remove EDM white layers and heat-affected zone.

By varying the size of the particles in the abrasive slurry, and using a finely controlled gap dimension, fairly sharp corners and edges in the workpiece 22 can be obtained, particularly when compared to other automated processes where larger gaps are used. This allows fairly complex shapes to be formed in the workpiece 22 having the desired surface characteristics.

As discussed briefly above, and as best shown in FIG. 9, in some embodiments the workpiece 22 can comprise a generally concave opening 88 that is polished by the action of the formable polishing tool 20. In some embodiments, this workpiece 22 is the finished product. However, in other embodiments the finished workpiece 22 constitutes a mold or other tool that can then be used for molding or otherwise forming a desired component. For example, as shown in FIG. 9, the workpiece 22 can be made of a metal and used in a molding process to create a corresponding component 94.

In some embodiments, the component 94 can be made of any suitable material such as a thermoplastic or a thermoset that is capable of being molded. As shown, the component 94 has a smooth lower portion 90*a* and a smooth upper portion 92*a* corresponding to a shallow workpiece surface 90*b* and a deep workpiece surface 92*b*, respectively. In an alternative embodiment, the workpiece 22 can be made of a ceramic material and used in a casting process to create component 94 out of a metal.

It will be appreciated that, in forming the component 94, a plurality of workpieces 22 could be provided such that multiple components 94 could be formed at one time. Furthermore, a combination of multiple differently formed workpieces 22 could be used in multi-step molding of components 94 where desired.

In some embodiments, depending upon the size of the workpiece 22 that is to be micro-machined, a plurality of different formable polishing tools 20 could be used to micro-machine the different areas of the workpiece 22. For example, where the workpiece 22 is especially large, a number of different formable polishing tools 20 could be provided, each having a different surface profile for micro-machining a different portion of the workpiece 22 in successive overlapping or non-overlapping sequences. This allows the size of the formable polishing tool 20 to be kept to a manageable size and the limitations of a particular working apparatus 10 to be accommodated while still micro-machining large workpieces 22.

According to some embodiments, while the main motion in micro-machining is generally in a direction parallel to the longitudinal axis A of the working apparatus 10, one or more auxiliary motions can also be applied during the micro-machining of the workpiece 22 to obtain desired surface characteristics. For example, transverse or circular motions can also be applied, causing the formable polishing tool 20 to move along a 3D path (orbital or otherwise), in addition to, or as an alternative to, movement along the longitudinal axis A.

In some embodiments, such lateral motion can be obtained by adjusting the geometry of the horn 16, causing it to act as an acoustic vibration amplifier, as best described with reference to in FIG. 3. As shown in FIG. 3, in one embodiment the upper portion 40 of the horn 16 generally has a cylindrical shape, and the horn 16 has a tapered portion 42 narrowing from the upper portion 40 to the working end 44. In some embodiments, the tapered portion 42 can have an asymmetric topology in order to generate varying lateral motion at the formable polishing tool 20. Specifically, in one embodiment the tapered portion 42 can include one or more recesses or dents, such as a first dent 46 located at a first distance $D_1$ from the working end 44 and a second dent 48 located at a second distance $D_2$ from the working end 44. The first and second dents 46, 48 can also be located at different angular positions around the tapered portion 42. For example, the first dent 46 and second dent 48 can be angularly offset by approximately 90 degrees as shown in FIG. 3.

During operation of the ultrasonic transducer 12, the first and second dents 46, 48 generate varying lateral motions in the working end 44 of the horn 16, which causes the formable polishing tool 20 to oscillate in along a complex 3D path.

According to some embodiments, changing the position of the dents 46, 48 along the tapered portion 42 of the horn 16 will modify the lateral resonant frequency of the working end 44 on which the formable polishing tool 20 is fixed. Generally, a larger distance between the dents 46, 48 and the working end 44 of the horn 16 tends to result in a lower lateral resonant frequency and a higher inertia of the working end 44. Such lower lateral resonant frequency is generally accompanied by a lower lateral displacement of the working end 44.

In some embodiments, lateral displacement of the formable polishing tool 20 could be further promoted by mounting the ultrasonic transducer 12 on a joint (such as a spherical joint) that would allow the transducer 12 to be tilted vertically, such as between 0 and 90 degrees in a vertical plane, and rotated by 0 to 360 degrees in a horizontal plane about the longitudinal axis A. Such a configuration would provide a way to induce uniform lateral motion throughout the gap between the workpiece 22 and the formable polishing tool 20 independently of the gap geometry.

The auxiliary movement of the formable polishing tool 20 can also include smaller 3D complex orbital motion, within the limits of the gap width, to promote flow of the abrasive fluid within the gap. Complex orbital motion of the formable polishing tool 20 can be effected using various techniques, for example by using standard electric motor actuators, such as the ones available on a conventional CNC machine tool, or by low frequency (0-2000 Hz) piezoelectric actuators, as discussed in more detail below with respect to FIGS. 10A to 11C and 13A to 14C.

In some embodiments, the use of one or more ultrasonic piezoelectric actuators oscillating at their natural frequencies (typically between 20,000 to 40,000 Hz) located proximate the formable polishing tool 20 itself can create auxiliary motion of the formable polishing tool 20. This auxiliary motion can generally be either along a single axis (such as along a trajectory parallel to the one or the X, Y or Z axes shown in FIG. 4A) or along a more complex trajectory having components along two or more axes. In other embodiments, monotonous lateral motions (along a plane defined by two of the X, Y and Z axes shown in FIG. 4A) of the formable polishing tool 20 can be achieved to perform the desired micro-machining of the workpiece 22.

Turning now to FIGS. 10A to 14C, according to some embodiments, the flow of abrasive slurry S within the cavity 38 can be controlled by movement of the formable polishing tool 20 in various 3D directions caused by an arrangement of one or more piezoelectric actuators mounted on the holder 18 that act like an ultrasonic 3-phase motor embedded within the molded formable polishing tool 20. In this manner, auxiliary motion can be generated during the vertical movement of the formable polishing tool 20.

Figure 10B:
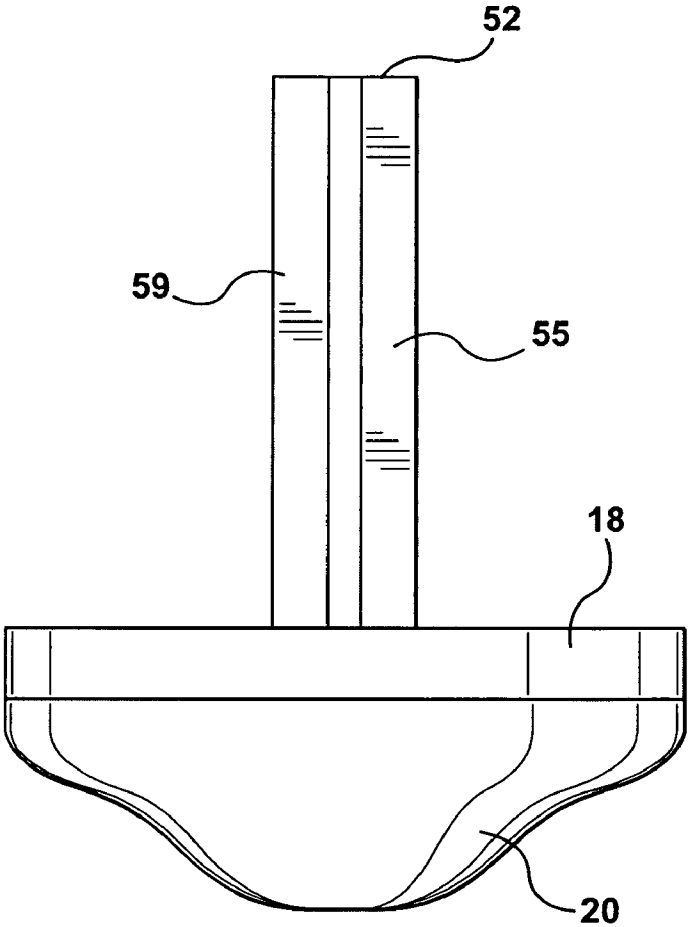
FIG. 10B is a side view of the tool holder and formable polishing tool of FIG. 10A.
Figure 10A:
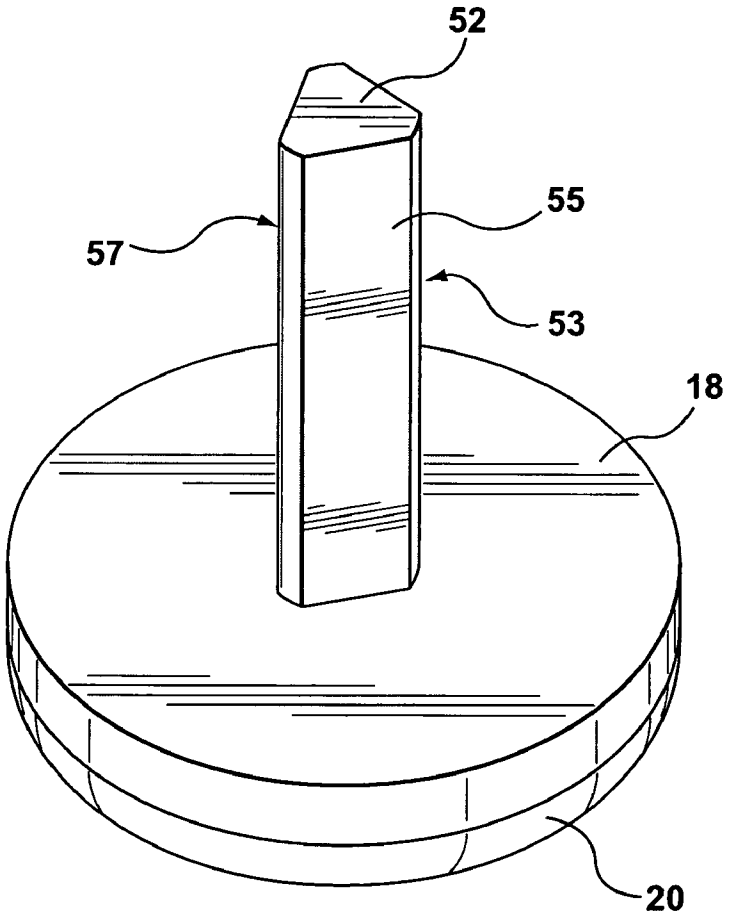
FIG. 10A is a perspective view of a tool holder and formable polishing tool according to one embodiment.
Figure 11C:
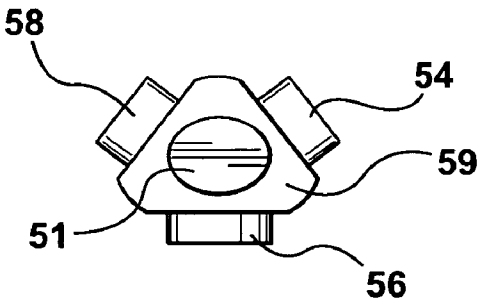
FIG. 11C is an end view of the tool holder of FIG. 11A.
Figure 11B:
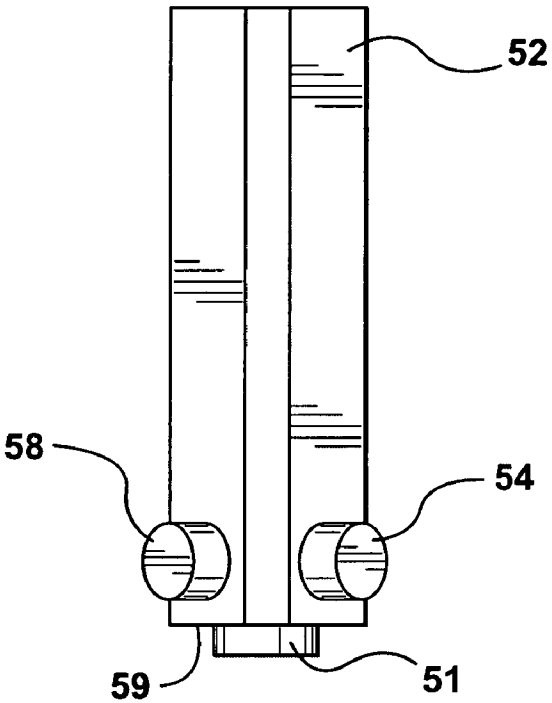
FIG. 11B is a side view of the tool holder of FIG. 11A.
Figure 11A:
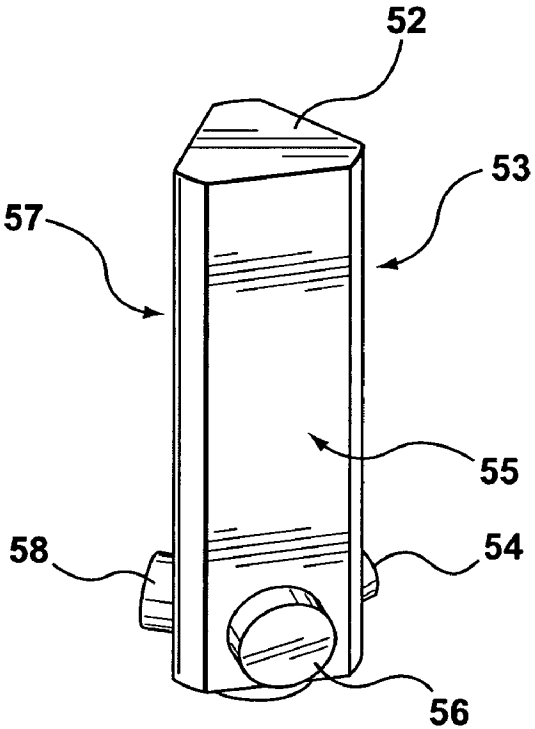
FIG. 11A is a perspective view of a tool holder according to one embodiment.

In one embodiment, as shown in FIGS. 10A to 11C, the holder 18 can be provided with a second coupler 52 being generally triangular in shape. A plurality of piezoelectric converters can then be mounted, one on each face of the triangular coupler 52, and configured to operate like a three phase ultrasonic motor. For example, as shown in FIGS. 11A to 11C, four piezoelectric actuators 51, 54, 56, 58 can generate abrasive fluid flow within the cavity 38 (being in some embodiments parallel to the surface of the workpiece 22 and/or the formable polishing tool 20) in the XY, YZ, and XZ planes and combinations thereof by synchronizing the time at which each piezoelectric converter 51, 54, 56, 58 is actuated in relation with the other piezoelectric converters 51, 54, 56, 58. By controlling the activation sequence, the piezoelectric converters 51, 54, 56, 58 can be used to generate a rotating wave over the surface of the entire formable polishing tool 20. By adjusting the synchronization of the actuators 51, 54, 56, 58, different waves can be generated in any desired plane, forcing the abrasive slurry S to "surf" on such wave and as a result flow within the gap between the workpiece 22 and the formable polishing tool 20 according to a desired pattern of flow.

For example, a first piezoelectric converter 54, a second piezoelectric converter 56 and a third piezoelectric converter 58 can be affixed to a first side 53 and second side 55 and a third side 57 of the coupler 52 respectively, with the forth converter 51 affixed to the bottom 59 of the coupler 52.

According to one cyclic sequence, the first 54 and second 56 converters are actuated while the third converter 58 is at rest, followed by driving the second 56 and third 58 converters while the first converter 54 is at rest, and then driving the first 54 and third 58 converters while the second converter 56 is at rest. This cyclic sequence will tend to cause the slurry S to rotate in a plane prescribed by piezoelectric converters 54, 56 and 58. The fourth converter 51 can also activated to give vertical flow orientation to the wave W of the slurry S.

As shown in FIGS. 10A and 10B, the piezoelectric converters 51, 54, 56 and 58 are generally encompassed within the body of one or more of the holder 18 and the formable polishing tool 20 such that they are normally not exposed once the formable polishing tool 20 has been formed. This protects the piezoelectric converters 51, 54, 56 and 58 from exposure to the abrasive slurry S and prevents them from being damaged when the working apparatus 10 is in use. The piezoelectric converters 51, 54, 56 and 58 used in this manner are typically low frequency (0 to 2000 Hz) piezoelectric actuators. However, it will be appreciated that different configurations of piezoelectric converters, including converters working at very different frequencies, could be used to effect different types of movement of the slurry S within the cavity 38.

Figure 12A:
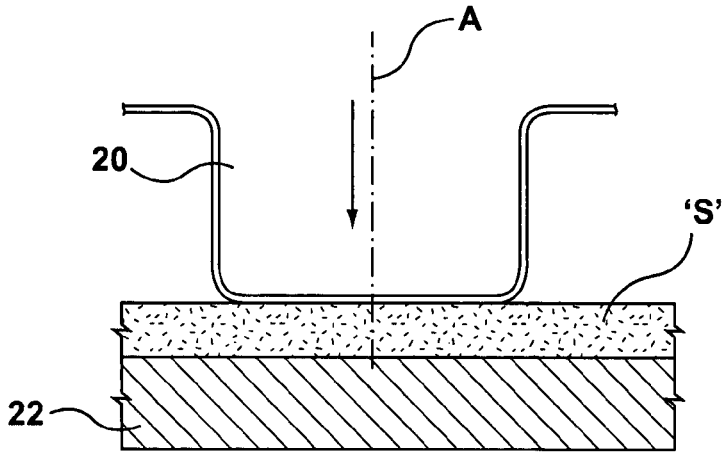
FIGS. 12A to 12C show a schematic representation of a wave developing in the slurry as a result of the auxiliary motion of a formable polishing tool.
Figure 12B:
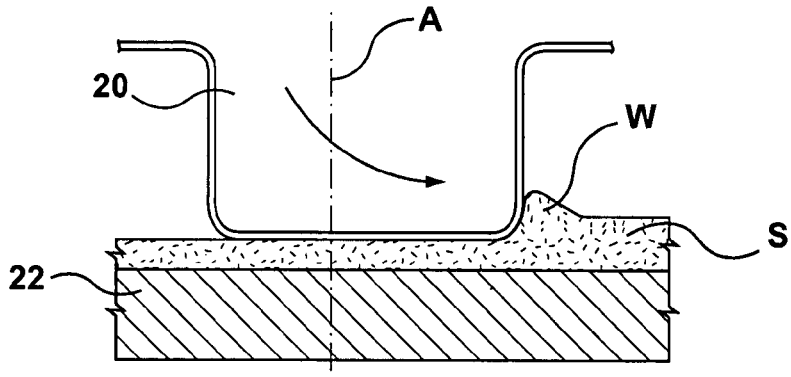
Figure 12C:
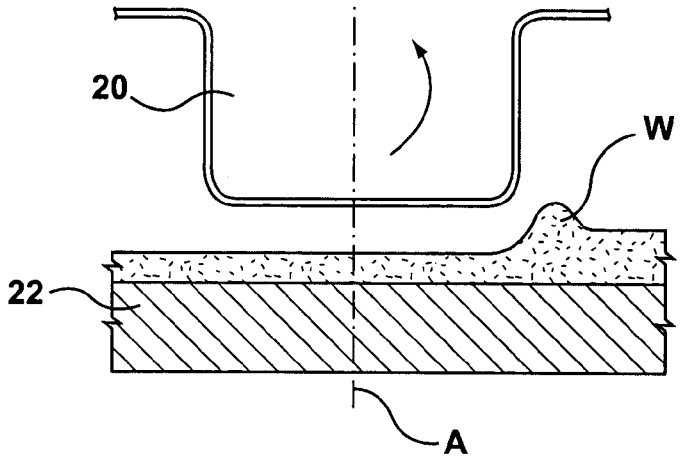
Figure 13B:
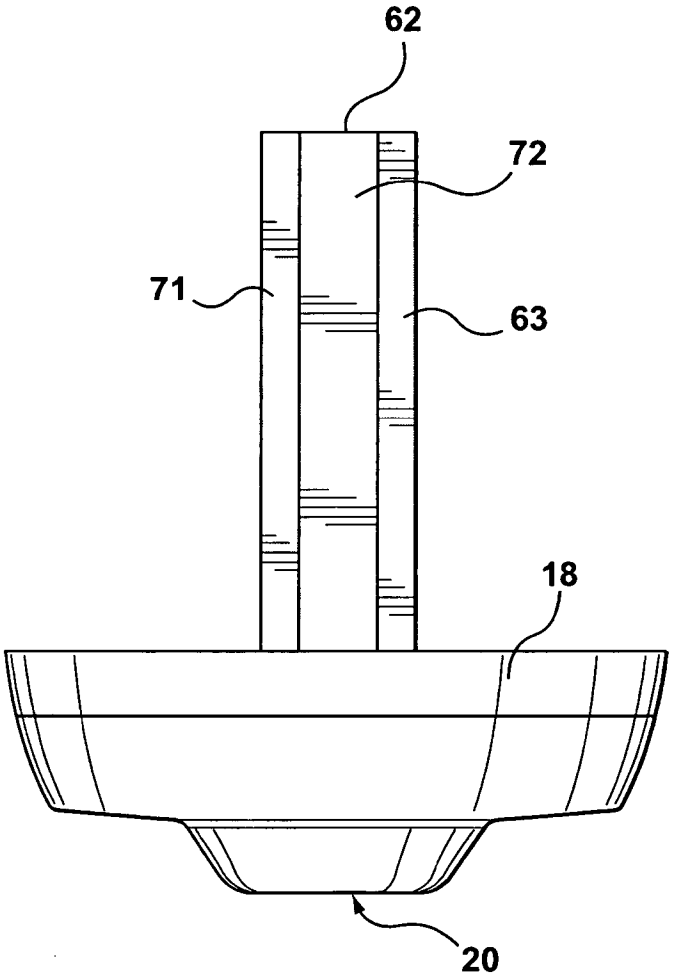
FIG. 13B is a side view of the tool holder and formable polishing tool of FIG. 13A.
Figure 13A:
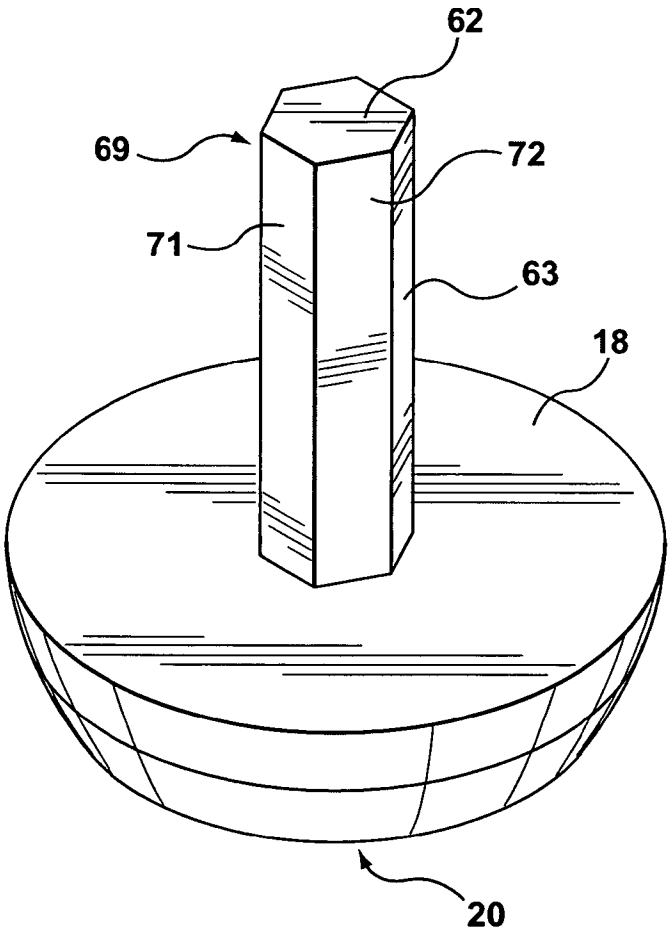
FIG. 13A is a perspective view of a tool holder and formable polishing tool according to another embodiment.
Figure 14C:
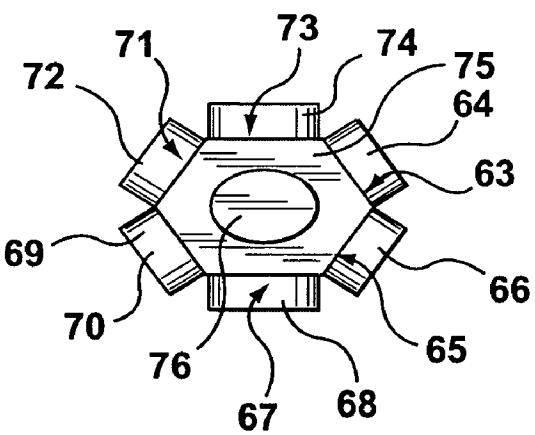
FIG. 14C is an end view of the tool holder of FIG. 14A.
Figure 14B:
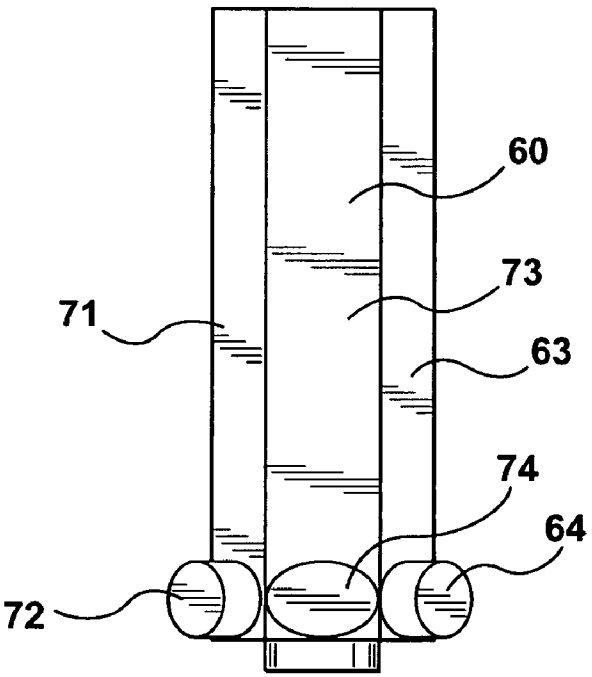
FIG. 14B is a side view of the tool holder of FIG. 14A.
Figure 14A:
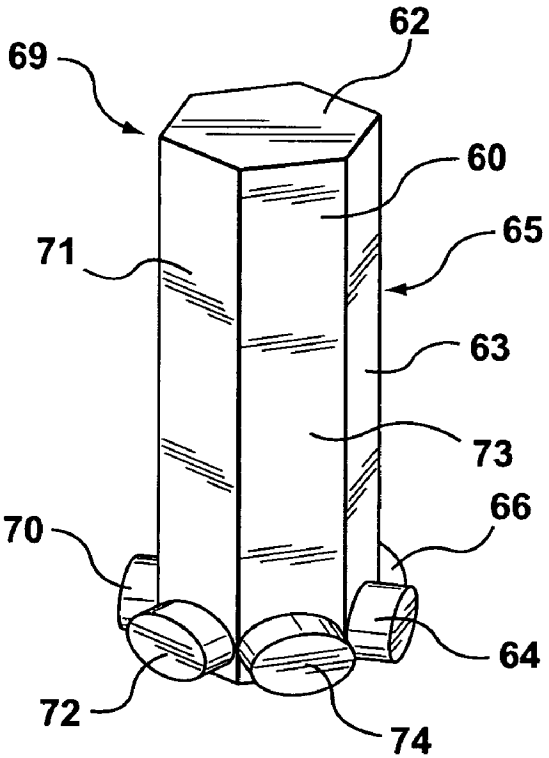
FIG. 14A is a perspective view of a tool holder according to one embodiment.
Figure 15:
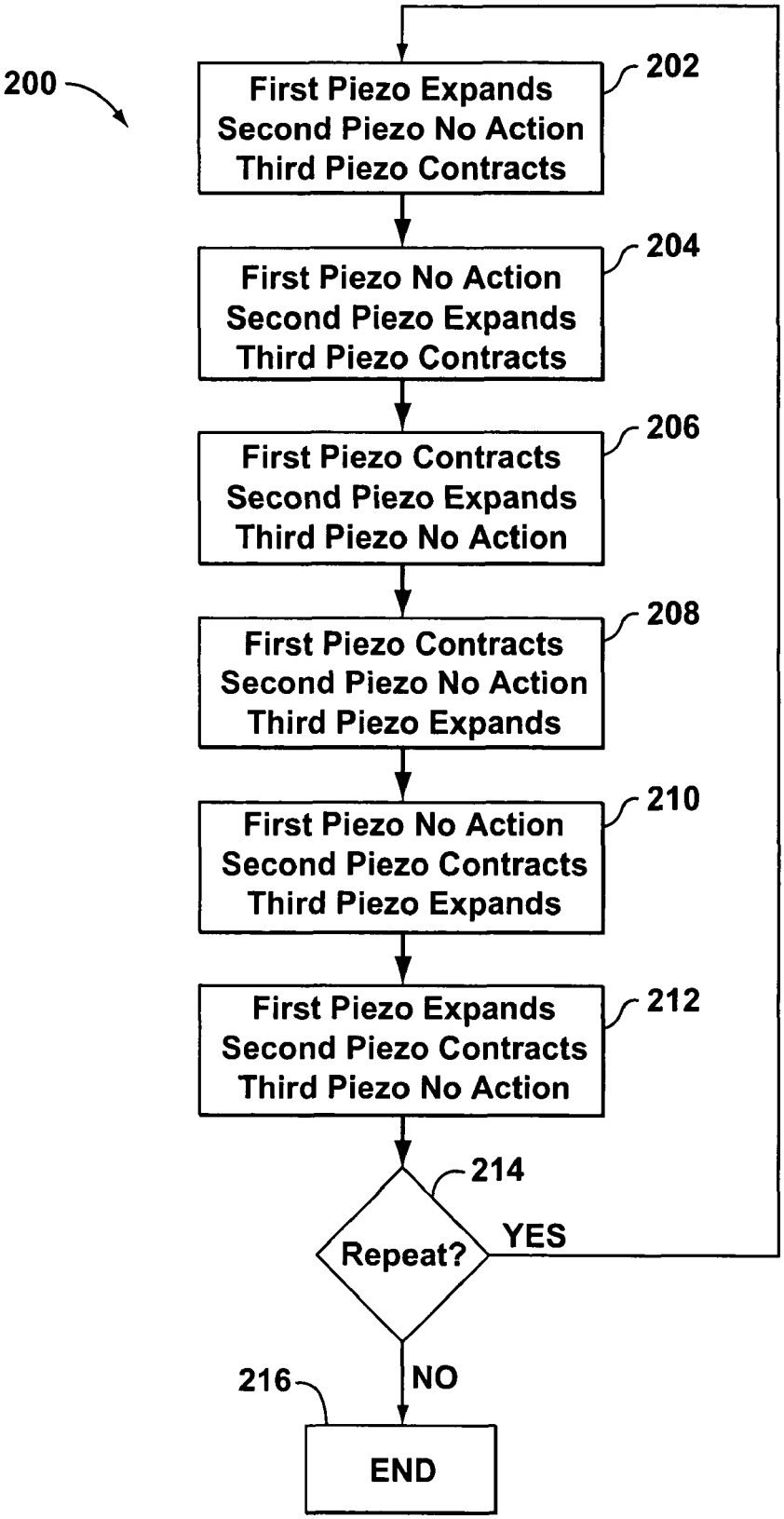
FIG. 15 is a schematic representation of a method for providing auxiliary motion of the formable polishing tool according to one embodiment.

For example, as shown in FIGS. 12A to 12C, during one cycle, the formable polishing tool 20 can move downwards into the slurry S from a position above it, as shown in FIG. 12A. At this stage, the slurry S sits relatively undisturbed on top of the workpiece 22.

As the formable polishing tool 20 continues to descend, as shown in FIG. 12B, the action of one or more of the piezoelectric converters (such as piezoelectric converters 51, 54, 56 and 58) causes the formable polishing tool 20 displace to one side, away from the longitudinal axis A, as the formable polishing tool 20 engages the slurry S. This lateral motion of the formable polishing tool 20 causes a wave W to be developed, which travels in front of the formable polishing tool 20.

Finally, as the formable polishing tool 20 reverses direction and begins traveling away from the surface of the workpiece 22 (as shown in FIG. 12C), this wave 'W' then continues traveling away from the longitudinal axis A, tending to carry with it spent abrasive particles and materials worn away from the workpiece 22 and formable polishing tool 20.

According to some embodiments, various other configurations of piezoelectric actuators could be used to generate different waveforms in the surface of the slurry S. For example, as shown in FIGS. 13A to 14C, a total of seven piezoelectric converters 64, 66, 68, 70, 72, 74, and 76 can be placed on six outer surfaces 63, 65, 66, 67, 69, 71, and 73 and the lower surface 75 of a coupler 62. The piezoelectric converters 64, 66, 68, 70, 72, and 74 can be arranged in pairs to form three phases along the XY plane and other phases in a combination of the XZ and YZ planes, forming a combination of 0°, 60° and 120° vertical planes. For example a first pair could consist of piezoelectric actuators 64 and 70, a second pair could consist of piezoelectric actuators 66 and 72, and a third pair could consist of piezoelectric actuators 68 and 74.

In some embodiments, the use of seven piezoelectric actuators 64, 66, 68, 70, 72, 74 and 76 can provide more symmetrical movement, tending to improve the stability and efficiency of the "pumping" or wave action generated. For example, each pair of piezoelectric actuators can act in direct opposition to its paired partner, using equal but opposite forces to effect significant but controlled movement of the formable polishing tool 20 and slurry S without requiring the use of heavy counter weights to prevent excess or potentially damaging forces to be built up.

In some embodiments, the use of paired piezoelectric actuators could result in the generation of small lateral elongations and contractions of the formable polishing tool 20 along an axis passing through each pair of piezoelectric actuators near the centerline. This lateral motion would locally reduce the gap between the formable polishing tool 20 and the workpiece in the gap area prescribed by the axis passing through each pair of piezoelectric actuators. By synchronizing the action of each pair of piezoelectric actuators, a pumping action can be generated in the plane of each of the three piezoelectric actuator pairs, effecting movement of the slurry S.

For example, in some embodiments, the piezoelectric actuators could be actuated in a sequence according to method 200.

At 202, a first pair of piezoelectric actuators (such as piezoelectric actuators 64 and 70) expands, a second pair of piezoelectric actuators (such as piezoelectric actuators 66 and 72) could remain inert, having no action, and a third pair of piezoelectric actuators (such as piezoelectric actuators 68 and 74) could contract.

At 204, the first pair of piezoelectric actuators has no action, the second pair of piezoelectric actuators expands, and the third pair of piezoelectric actuators contracts.

At 206, the first pair of piezoelectric actuator contracts, the second pair of piezoelectric actuators expands, and the third pair of piezoelectric actuators has no action.

At 208, the first pair of piezoelectric actuators contracts, the second pair of piezoelectric actuators has no action, and the third pair of piezoelectric actuators expands.

At 210, the first pair of piezoelectric actuators has no action, the second pair of piezoelectric actuators contracts, and the third pair of piezoelectric actuators expands.

At 212, the first pair of piezoelectric actuators expands, the second pair of piezoelectric actuators contracts, and the third pair of piezoelectric actuators has no action.

At 214, a determination is made as to whether method 200 is to be repeated. If the method 200 is to be repeated, then method 200 returns to 202. Alternatively, if the method 200 is not to be repeated, then method 200 proceeds to 216 and ends.

In this manner, wave W can be generated in the slurry S and can be controlled with a high degree of precision by the expansion and contraction of each respective pair of actuators.

In some embodiments, the fourth piezoelectric actuator 76 is not matched in a pair with another piezoelectric actuator, since the horn inertia 16, holder 18 and formable polishing tool 20 naturally counteract the movement of the fourth piezoelectric actuator 76 along the longitudinal axis A. Using the fourth piezoelectric actuator 76 in conjunction with two other pairs of piezoelectric actuators could be used to promote vertical pumping of the slurry S as desired.

In some embodiments, the seven piezoelectric actuators could be located on the formable polishing tool holder 18, horn 16 or structure 14 instead of being incorporated within the formable polishing tool 20.

According to some embodiments, micro-machining of the workpiece 22 can be accomplished by placing the formable polishing tool 20 in direct contact with the workpiece 22, without the use of a slurry S. A similar micro-machining method is applied as described above, with the exception that the formable polishing tool 20 micro-machines the surface of the workpiece 22 by direct contact between the face of the formable polishing tool 20 and the surface of the workpiece 22. In such embodiments, instead of using a hard formable polishing tool 20, a softer compliant material would be used for direct contact micro-machining. For example, a soft silicon elastomeric polymer can be either used as is or filled with abrasive powder. Then, instead of keeping a gap between the formable polishing tool 20 and workpiece 22 during polishing, the formable polishing tool 20 is pushed against the workpiece 22 surface in a way that the pressure on the surface of the workpiece 22 can be finely controlled by controlling the amount of deformation permitted in the elastomeric formable polishing tool 20. The basic oscillatory motion can be complemented by an auxiliary complex 3D orbital motion applied to the holder 18 in order to more uniformly micro-machine complex surface geometry on the workpiece 22.

According to one variation of the above polishing process, an elastomeric compound in the formable polishing tool 20 can be saturated with abrasive particle of desired grade. Then, micro-machining can be done without adding abrasive solution in the gap but with only a lubricant such as water, oil, emulsion or no lubricant at all if desired.

Figure 16:
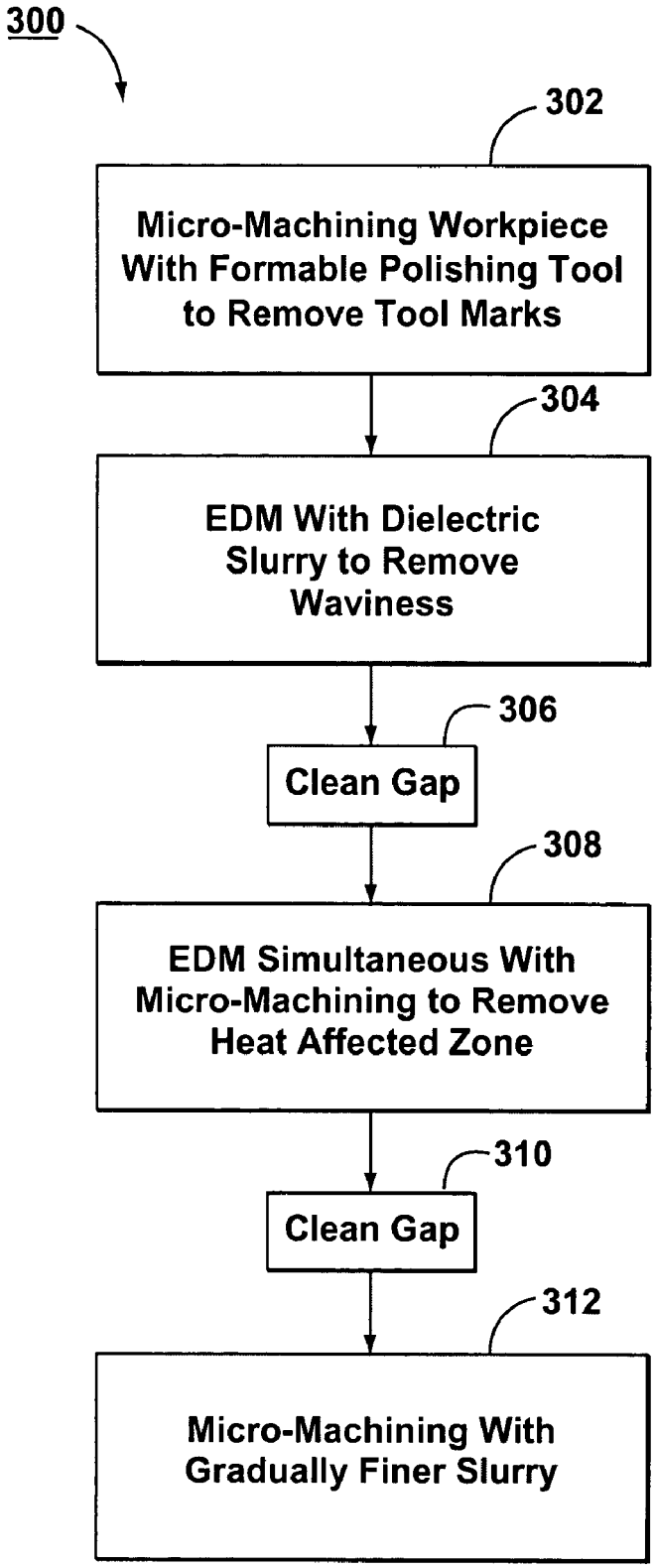
FIG. 16 is schematic representation of a method of combining micro-machining with electric discharge machining.

Turning now to FIG. 16, a method 300 of combining an ultrasonic micro-machining process with an Electric Discharge Machining (EDM) process is described according to one embodiment. In certain cases, when used with a formable polishing tool 20 that is electrically conductive (e.g. when the formable polishing tool is formed of an electrically conductive composite material, such as a polymer composite having graphite powder or copper powder as filler), the ultrasonic micro-machining process can be combined with an EDM process within the same working apparatus 10 to remove material from a workpiece 22 in either an alternating or simultaneous sequence.

Generally, the abrasive slurry S used in the ultrasonic micro-machining process detailed above could readily be used as a dielectric medium since its main component is typically water or oil, which are the base dielectric fluids used in EDM. Moreover, some EDM applications require the addition of fine particles in the dielectric fluid, such as silicon, in order to better diffuse the spark discharge and as a result improve the surface finish on the workpiece 22, similar to the fine abrasive particles in the abrasive slurry. For example, in ultrasonic micro-machining, the slurry could be made of 10% to 50% wt SiC powder in grades varying from 5 to 200 μm with respective percent wt of water or oil. In addition, the formable polishing tool 20 could be made of 70% wt graphite powder with UHMWPE polymer matrix which would be functional for both ultrasonic and EDM processes.

For example, the method 300 of performing micro-machining and EDM in combination could include, at 302 micro-machining a workpiece using a formable polishing to remove tool marks on the workpiece. This could include performing ultrasonic micro-machining using an oil-based slurry having 150 μm abrasive particles.

At 304, an EDM process can be performed using the same formable polishing tool and the same dielectric slurry to remove any waviness that may have occurred in the surface of the workpiece.

At 306, the gap between the workpiece and the formable polishing tool can be cleaned to remove any particulates that may have been formed during the micro-machining and EDM processes, and the oil-based slurry is removed.

At 308, an EDM process can be performed simultaneously with an ultrasonic micro-machining to remove some of the heat affected zone on the workpiece using a water-based slurry having 40% wt 60 μm SiC abrasive particles.

At 310, the gap between the workpiece and the formable polishing tool is again cleaned to remove any particulates that may have been formed.

At 312, an ultrasonic micro-machining process can be performed using gradually finer abrasive particles to achieve the desired surface finish on the workpiece. For example, this could involve micro-machining using slurry having gradually finer SiC and diamond particles, such as 25% wt 12 μm and 15% wt 5 μm abrasive particles.

While the above description includes a number of exemplary embodiments, many modifications, substitutions, changes, and equivalents will now occur to those of ordinary skill in the art. It is, therefore, to be understood that the appended claims are intended to cover all such modifications and changes.

The invention claimed is:

1. A method of micro-machining a surface of a workpiece having a complex surface profile including desired profile features and finer undesired profile features to be removed, comprising:

providing a formable polishing tool, said formable polishing tool comprises a thermoplastic polymer selected from the group consisting of high density polyethylene or ultra high molecular weight polyethylene, said thermoplastic polymer having a solid filler additive for controlling the thermal conductivity and speed of sound in said formable polishing tool;

shaping said formable polishing tool using either the workpiece itself or a replica of the workpiece to have at least said desired profile features;

and using said formable polishing tool to micro-machine said workpiece surface to remove said finer undesired profile features while maintaining said desired profile features.

2. The method of claim 1, wherein:

the formable polishing tool is shaped to have at least said desired profile features by pressing the formable polishing tool against either the workpiece itself or the replica of the workpiece when the formable polishing tool is in a formable state, and the formable polishing tool is used for micro-machining when the formable polishing tool is in a solid state.

3. The method of claim 2, wherein:

the formable polishing tool comprises a thermoformable material being in the formable state at a first temperature and being in the solid state at a second temperature, the second temperature being lower than the first temperature; and said shaping of said formable polishing tool has been shaped by pressing the formable polishing tool against either the workpiece itself or the replica of the workpiece while at the first temperature, and then cooling the formable polishing tool to the second temperature.

4. The method of claim 3, further comprising:

oscillating the formable polishing tool against either the workpiece itself or the replica of the workpiece during cooling of the formable polishing tool to the second temperature to modify the profile of the formable polishing tool.

5. The method of claim 3, further comprising determining that the formable polishing tool is in a worn state; and reforming the formable polishing tool by heating the formable polishing tool to the first temperature, pressing the formable polishing tool against either the workpiece itself or the replica of the workpiece while at the first temperature, and then cooling the formable polishing tool to the second temperature.

6. The method of claim 1, further comprising providing an abrasive slurry between the formable polishing tool and the workpiece, wherein the use of the formable polishing tool causes the slurry to micro-machine the complex surface profile of the workpiece.

7. The method of claim 6, wherein auxiliary motion is applied to said formable polishing tool during micro-machining of said surface to remove said finer undesired profile features while maintaining said desired profile features, said auxiliary motion being applied to effect movement of the abrasive slurry.

8. A method of making a component from a workpiece having a complex surface profile including desired profile features and finer undesired profile features to be micro-machined, comprising:

providing a formable polishing tool, said formable polishing tool comprises a thermoplastic polymer selected from the group consisting of high density polyethylene or ultra high molecular weight polyethylene, said thermoplastic polymer having a solid filler additive for controlling the thermal conductivity and speed of sound in said formable polishing tool;

shaping said formable polishing tool using either the workpiece itself or a replica of the workpiece to have at least said desired profile features;

then using said formable polishing tool to micro-machine said finer undesired profile features while maintaining said desired profile features; and then forming the component using the workpiece.

9. The method of claim 8, wherein:

said shaping of the formable polishing tool is shaped to have at least said desired profile features by pressing the formable polishing tool against either the workpiece itself or the replica of the workpiece when the formable polishing tool is in a formable state, and the formable polishing tool is used for micro-machining when the formable polishing tool is in a solid state.

10. The method of claim 8, wherein:

the formable polishing tool comprises a thermoformable material being in the formable state at a first temperature and being in the solid state at a second temperature, the second temperature being lower than the first temperature, said shaping of said formable polishing tool has been shaped by pressing the formable polishing tool against either the workpiece itself or the replica of the workpiece while at the first temperature, and then cooling the formable polishing tool to the second temperature.

11. The method of claim 10, further comprising:

oscillating the formable polishing tool against either the workpiece itself or the replica of the workpiece during cooling of the formable polishing tool to the second temperature to modify the profile of the formable polishing tool.

12. The method of claim 8, further comprising providing an abrasive slurry between the formable polishing tool and the workpiece, wherein the use of the formable polishing tool causes the slurry to micro-machine the complex surface profile of the workpiece.

13. The method of claim 8, wherein the workpiece comprises a mold, and further comprising molding the component using the mold.

14. A micro-machining apparatus for micro-machining a workpiece having a complex surface profile including desired profile features and finer undesired profile features to be micro-machined, the apparatus comprising:

a formable polishing tool configured to micro-machine said finer undesired profile features while maintaining said desired profile features, said formable polishing tool comprises a thermoplastic polymer selected from the group consisting of high density polyethylene or ultra high molecular weight polyethylene, said thermoplastic polymer having a solid filler additive for controlling the thermal conductivity and speed of sound in said formable polishing tool;

a transducer for driving said polishing tool;

wherein the formable polishing tool has been shaped to have at least said desired profile features using either the workpiece itself or a replica of the workpiece.

15. The micro-machining apparatus of claim 14, wherein:

the formable polishing tool is shaped to have at least said desired profile features by pressing the formable polishing tool against either the workpiece itself or the replica of the workpiece when the formable polishing tool is in a formable state, and the formable polishing tool is used for micromachining when the formable polishing tool is in a solid state.

16. The micro-machining apparatus of claim 14, wherein:

the formable polishing tool comprises a thermoformable material being in the formable state at a first temperature and being in the solid state at a second temperature, the second temperature being lower than the first temperature; and the formable polishing tool has been shaped by pressing the formable polishing tool against either the workpiece itself or the replica of the workpiece while at the first temperature, and then cooling the formable polishing tool to the second temperature.

17. The micro-machining apparatus of claim 16 wherein:

the formable polishing tool is oscillated against either the workpiece itself or the replica of the workpiece during cooling of the formable polishing tool to the second temperature to modify the profile of the formable polishing tool.

18. A formable polishing tool for use with a micro-machining apparatus for micro-machining a workpiece having a complex surface profile including desired profile features and finer undesired profile features to be micro-machined, said formable polishing tool is configured to micro-machine said finer undesired profile features while maintaining said desired profile features, said formable polishing tool having been shaped when in the formable state to have at least said desired profile features by using either the workpiece itself or a replica of the workpiece, wherein said formable polishing tool comprises a thermoplastic polymer selected from the group consisting of high density polyethylene or ultra high molecular weight polyethylene, said thermoplastic polymer having a solid filler additive for controlling the thermal conductivity and speed of sound in said formable polishing tool.

19. The formable polishing tool of claim 18, wherein:

the formable polishing tool is shaped to have at least said desired profile features by pressing the formable polishing tool against either the workpiece itself or the replica of the workpiece when the formable polishing tool is in a formable state, and the formable polishing tool is used for micro-machining when the formable polishing tool is in a solid state.

20. The formable polishing tool of claim 19, wherein:

the formable polishing tool comprises a thermoformable material being in the formable state at a first temperature and being in the solid state at a second temperature, the second temperature being lower than the first temperature; and the formable polishing tool has been shaped by pressing the formable polishing tool against either the workpiece itself or the replica of the workpiece while at the first temperature, and then cooling the formable polishing tool to the second temperature.

21. The method of claim 1, wherein said polishing tool is driven by an ultrasonic transducer.

22. The method of claim 8, wherein said polishing tool is driven by an ultrasonic transducer.

23. The micro-machining apparatus of claim 14, wherein said transducer is an ultrasonic transducer, and said polishing tool is coupled to said transducer using a horn.

* * * * *